United States Patent [19]

Hooper

[11] Patent Number: 4,534,426

[45] Date of Patent: Aug. 13, 1985

[54] PACKER WEIGHTED AND PRESSURE DIFFERENTIAL METHOD AND APPARATUS FOR BIG HOLE DRILLING

[75] Inventor: David W. Hooper, Huntington Beach, Calif.

[73] Assignee: Unique Oil Tools, Inc., Rolling Hills, Calif.

[21] Appl. No.: 525,998

[22] Filed: Aug. 24, 1983

[51] Int. Cl.[3] ..... E21B 7/00; E21B 17/00

[52] U.S. Cl. ..... 175/65; 175/215; 175/324; 175/325

[58] Field of Search ..... 175/215, 65, 69, 71, 175/325, 320, 230, 324

[56] References Cited

U.S. PATENT DOCUMENTS

| | | | |
|---|---|---|---|
| 2,112,254 | 3/1938 | Stokes | 175/325 X |
| 2,946,565 | 7/1960 | Williams | 166/264 |
| 3,376,942 | 4/1968 | Van Winkle | 175/215 X |
| 3,578,078 | 5/1971 | Shillander | 166/196 X |
| 3,638,742 | 2/1972 | Wallace | 175/215 X |
| 3,799,260 | 3/1974 | Barrington | 166/196 X |
| 3,840,080 | 10/1974 | Berryman | 175/107 |
| 3,841,421 | 10/1974 | Matsushita | 175/215 X |
| 3,948,330 | 4/1976 | Langford, Jr. | 175/213 X |
| 3,958,651 | 5/1976 | Young | 175/213 X |
| 4,057,118 | 11/1977 | Ford | 175/325 X |
| 4,227,583 | 10/1980 | Benjamin | 175/65 |
| 4,240,513 | 12/1980 | Castel et al. | 175/340 |
| 4,245,708 | 1/1981 | Cholet et al. | 175/325 |

FOREIGN PATENT DOCUMENTS

| | | | |
|---|---|---|---|
| 0623954 | 9/1978 | U.S.S.R. | 175/324 |
| 0653386 | 3/1979 | U.S.S.R. | 175/230 |

*Primary Examiner*—Stephen J. Novosad
*Assistant Examiner*—Hoang C. Dang
*Attorney, Agent, or Firm*—William H. Maxwell

[57] ABSTRACT

A packer and pressure differential drilling tool and method of controlled pressure balanced drilling in Big Hole well bores and shafts, characterized by a large diameter packer slideably engaged with the well bore over a drill bit and through which a dual drill pipe operates and isolates drilling fluid from a hydrostatic head of fluid standing in the well bore surrounding the dual drill pipe, the packer functioning as a non-rotatable ram slideable down the well bore and supporting said hydrostatic head and applying the weight thereof to the drill bit through anti-friction bearings, cuttings being flushed through the dual drill pipe by means of aerated drilling fluid or by an upwardly disposed jet pump, or both, so as to establish a reduced and/or underbalanced condition at the bit-to-bore bottom interface and operating the drill bit at an increased rate of penetration while maintaining a higher pressure condition in the well bore above the packer, the packer being weight set or hydraulic set, and the jet pump being centered in the dual drill pipe or disposed in the annulus of the dual drill pipe.

70 Claims, 16 Drawing Figures

1ST. FORM
HEAD PRESSURE
AERATED FLUID
11
11'
11"
26
24
25
23
5
39
30
40
36
41
C
37
35
34
31
22
3
3
B
33
22
33
27
33
33
28
21
19
21
21
21
20
10
20
20
20
20

2ND. FORM
HEAD PRESSURE
11'
11
11"
S
42
C
6
B
A
27
J
42
28
21
19
21
21
D
21
10
21
43
6

3 RD. FORM

4 TH. FORM
HEAD PRESSURE
11'
11
11"
23b
52
42
11
47'
J2
41
35
46'
45
42
11
A
27
72
21
19
21
21
21
48'
20
20
10
20
20
20

5 TH. FORM

PACKER WEIGHTED AND PRESSURE DIFFERENTIAL METHOD AND APPARATUS FOR BIG HOLE DRILLING

BACKGROUND

This invention is concerned with the rotary method of "Big Hole" shaft drilling wherein hydraulic fluid, usually "mud", is pumped down the drill string and onto the bottom of the hole to clean the bit rollers and to flush the chips up the well bore. A great deal of effort has been expended on bottom hole cleaning coupled with drill bit design, in order to increase penetration rate, and mud pressure and its hydrostatic head is a controlling factor in this drilling efficiency. The weight of the mud is controlled and related to the bottom hole pressure required because of the pore pressure, represented by "formation pressure gradient", that presents an instantaneous boundary pressure interface of mud-to-formation at and surrounding the drill bit. The formation pressure gradient varies with depth and type of formation entered into, and it can change rapidly and unexpectedly resulting in "blowouts" or "kicks", which has required blowout prevention equipment installed at the surface as a first line of defense.

Large diameter mine shafts, leaching holes, access shafts to oil shale and tar sands and the like, and wells in general, are being established by means of large drilling rigs operating in the conventional "Rotary Drilling" mode. The two characteristic features of rotary drilling are the presence of a drilling fluid column and the weight of the drilling string applied to the drill bit. Similarly, with large diameter "Big Hole" drilling, the drilling fluid stands in the well bore so as to apply its hydrostatic head at the bit-to-bore bottom interface, and the relatively small weight of the drilling string is augmented by the applied mass of doughnut-shaped discs analogous to a stack of coins, so as to provide the necessary weight as the drill bit turns to make the hole. In practice for example, such weights rotate with the bit and are made of cast iron each 130 inches in diameter weighing 182,000 lbs.; and a plurality of these weights are normally used totaling as much as or more than one million pounds; and all of which requires a commensurate drilling rig with great weight handling and/or lifting ability.

In view of these prior art practices, it is a general object of this invention to utilize the hydrostatic head of drilling fluid or the like standing in the well bore, and its downward force as the primary weight applied to the drill bit, and eliminating the necessity of a rotating mass heretofore applied by drill collars and the like discs as above referred to. The present invention is characterized by a packer at and over the drill bit, that applies the hydrostatic head of fluid standing in the well bore to the drill bit, while separating the bit-to-bore bottom interface from said standing hydrostatic head whereby differential drilling is made possible in accordance with the teaching of my co-pending application Ser. No. 496,133, filed May 19, 1983, entitled DIFFERENTIAL PRESSURE DRILLING TOOL METHOD AND APPARATUS FOR WELL DRILLING, refiled Dec. 26, 1984 as continuation in part application Ser. No. 686,241 entitled ANNULUS BYPASS PERIPHERAL NOZZLE JET PUMP PRESSURE DIFFERENTIAL DRILLING TOOL AND METHOD FOR WELL DRILLING.

With these factors in mind, the driller normally proceeds with control over weight and pressure to establish an "over balanced" condition by substantially equalizing or exceeding the formation pressure at the bottom of the hole, and it is generally accepted by drillers that in deep-hole drilling the bit hydraulics has a major effect upon the rate of penetration. It is also accepted that the rate of penetration can be increased greatly with "under balanced" conditions at the bit, but with the risk of cave-in and uncontrolled implosion of the well bore at and surrounding the lower end of the drill string. In view of the foregoing, it is a general object of this invention to provide a pressure differential drilling tool, method and apparatus for increasing the rate of penetration in Big Hole drilling.

The formation pore pressure at the bottom of a mine shaft or well bore varies with the depth and the type of formation, and which can be calculated by using as a factor the "formation pressure gradient" of the formation to be penetrated. The average formation pressure gradient in the Continental United States is 0.465 p.s.i. per foot of depth; and the maximum abnormal therefor is accepted as 1.0 p.s.i. per foot of depth. The "formation pressure gradient" can be defined as the compaction pressure, the pore pressure, which the formation exhibits and from which condition it can unexpectedly release as in the case of a sudden opening from the formation and into the well bore. With an under balanced condition the formation will become sensitive and tend to implode, for purposes of this invention.

As stated above, the formation pressure gradient is important in the drilling process because it is a factor which determines the need for pressure and hydrostatic head applied in order to keep the formation intact and thereby prevent collapse of the well bore. The bit nozzles or jets are another factor, as they restrict flow and control pressure. Accordingly, pump pressure, jet restriction and hydrostatic head pressure of the mud are the controlling factors employed to establish "over balanced" and "under balanced" conditions as related to the pore pressure and the formation pressure gradient thereof, it being an object of this invention to provide a drilling tool for pressure differential drilling that subjects the large diameter bit-to-bore bottom interface to an under balanced condition, while subjecting the drill string above the bit to a higher or an over balanced condition. With the present invention, the differential condition is immediate to the bit, whereby cutting action at the bit-to-bore bottom interface is under balanced for rapid penetration, and whereby the hole above the bit is at higher pressure and/or over balanced for pore pressure mud column equilibrium.

The pressure differential apparatus and method of drilling herein disclosed is characterized by the pressure separation below and above the bit, thereby establishing distinct pressure zones, it being an object of this invention to pack off the bit during the drilling operation, so that an under balanced condition can prevail at the bit-to-bore bottom interface, and so that a higher pressure or an over balanced condition can prevail above the bit. Accordingly, a packer is provided at and above the bit to partition the bore through which the packer advances as hole is made. In practice, an expansible elastomer packer is employed and through which the drill string rotates.

The present invention requires the expanded packer to slideably engage the well bore closely behind the drill bit, it being an object of this invention to advantageously utilize the packer for the principle purpose of weight application, and also for stabilization. In the normal practice of Big Hole rotary drilling, the drill string weight is insufficient and consequently a large number of disc-shaped weights are used together with winged stabilizers, in order to make straight hole. With the present invention, the packer close above the drill bit inherently applies the weight of the hydrostatic head of fluid standing in the well bore and also centers the bit in the well bore for concentric bit-to-bore interface engagement. In practice, this packer-stabilizer slides down the well bore substantially without rotation and turns on the drill pipe or pipes with anti-friction thrust bearings, as will be described.

The state of the art employs dual wall or concentric drill pipe that separates the active drilling fluid from the static fluid standing within the large diameter well bore. For example, well shafts 20 feet in diameter are currently bored to 3,000 foot depth; 10 foot diameter shafts to 5,000 foot depth, etc.; utilizing an outside drill pipe up to 20 inches in diameter. The inside drill pipe of the dual string is approximately half the diameter of the outside drill pipe, forming an annulus for the flow of well fluid. The torque requirement for a 20 foot diameter drill bit is considered to be approximately 500,000 foot pounds, and this torque is accommodated chiefly by the outside drill pipe that is coupled to the drill bit as will be described.

A feature of Big Hole drilling is the confinement of circulating fluid to the dual drill pipe, with mud pump pressure applied through the inner drill pipe and return fluid and chips through the annulus between the two drill pipes, or vice versa. Aerated drilling fluid is also employed as an air lift for efficient removal of the huge volume of chips or cuttings produced by the Big Hole bits. Accordingly, it is an object of this invention to advantageously employ aerated drilling fluid under mud pump pressure to actuate the aforesaid packer, and alternately isolated from the said packer when it is weight set, and in both instances isolated so that full effect of the hydrostatic head in the well bore annulus surrounding the dual drill pipe string is effective as weight upon the packer and applied to the bit-to-bore bottom interface for effective drilling.

It is an object of this invention to control a large diameter packer during lowering of the drill string and also during the drilling operations, and to this end the packer is expansible in response to the application of weight or hydraulic pressure, and specifically through the application of mud pump pressure. With one form of the present invention, the packer is weight set by the drill bit setting on the bore bottom. With another form of the present invention, the packer is hydraulically operated in response to circulating fluid pressure. The cutter cleaning jets of the drill bit are preferably supplied with fluid from the well bore annulus surrounding the dual drill pipe.

A primary object of this invention is to isolate the operational fluid pressure above and below the drill bit, to generate a differential pressure in the separated and distinct zones below and above the packer, and to establish an effective hydrostatic head upon the packer that applies the necessary weight conducive to efficient drilling. Further, said distinct zones below and above the drill bit are isolated from the aforesaid pressure and return flow of circulating fluid within and through the dual drill pipes. In the basic form aerated circulating fluid is sufficient to flush the cuttings or chips. However, in the preferred and improved form the drill bit and drill string apparatus is essentially mechanical-hydraulic in its operational functions, and it is the inherent presence of dynamic fluid under pressure that is employed herein to generate the differential pressure that establishes a significant under balanced condition distinct from a balanced or over balanced condition. A feature of the present invention is the inclusion therein of at least one or more jet pumps operable in the well bore occupied by the aforesaid packer. Either aerated or non-aerated circulating fluid is employed to operate the jet pump, the aerated fluid having its advantageous effect to accelerate flushing up the dual drill pipe. The jet pump per se operates without moving parts and is capable of lifting a greater volume of fluid than is required therefor through its ejector for operation. It is the differential in pressure between the intake plenum and discharge venturi with which this invention is primarily concerned, a differential calculated to reach substantial proportion.

An object of this invention is to cooperatively combine a Big-Hole drill bit with an overlying and surrounding packer, and in one form of the invention advantageously utilizing the drill pipe annulus for the jet pump plenum, venturi and diffuser, and including the ejector of the pump therein. Characteristically, the dual drill pipe is embodied in the tool and has a through passage configuration that passes drilling chips through the drill pipe annulus to be carried away by the accelerated upward flow of aerated drilling fluid therethrough. A feature is that the jet pump revolves within the surrounding packer when it is set. Alternately, the packer is either pressure set or weight set, being pressure set by the application of circulating fluid pressure, and being weight set by the application of drill pipe weight, all as later described.

Another object of this invention is to cooperatively combine a Big Hole drill bit with an overlying and surrounding packer, and in one form of the invention advantageously utilizing the center pipe of the dual pipe drill string for the jet pump plenum, venturi and diffuser, and including the ejector of the pump therein. Characteristically, the dual drill pipe is embodied in the tool and has a through passage configuration that passes drilling chips through the center drill pipe to be carried away by the upward flow of said drilling fluid therethrough. A feature is that the jet pump revolves within the surrounding packer when it is set. Alternately, the packer is either pressure set or weight set, being pressure set by the application of circulating fluid pressure, and being weight set by the application of drill pipe weight, all as later described.

It is still another object of this invention to isolate the hydrostatic head of pressure in the annulus surrounding the aforesaid dual drill pipe from the drilling fluid circulated therethrough, and advantageously utilizing said annulus fluid surrounding the dual drill pipe to supply the bit jets with fluid for flushing the cuttings or chips. It is also an object, in this respect of fluid isolation, to utilize the circulating fluid pressure solely for the establishment of differential pressure at the bit-to-bore bottom interface with simultaneous induction flow of fluid from the hydrostatic head thereof in the well bore annulus surrounding the dual drill pipe. In practice, the hydrostatic head of fluid under pressure in the well bore above the packer is by-passed into the body of the drill bit where is supplies the cutter cleaning bit jets, as will be described.

The Big-Hole packer tool and/or packer-jet pump tool that I provide is a basic element of the well or shaft drilling apparatus of the present invention, and its utility as thus far described is associated directly with the drill bit for increasing the rate of making hole. However, it is to be understood that there are other apparatus features and combinations thereof wherein this hole packing tool and/or differential pressure packing tool can be usefully employed. It is the isolation of well fluids and the differential pressure control thereof which is of particular concern and to this end it is an object to selectively apply and remove hydraulic pressures to and from the packer, and accordingly I employ valve means operable by a "go-devil", or "knock-down plug" or "pump-down plug" or "wire line", as circumstances require. Vibration damping is inherent with this packer and drill bit combination, due to the frictional engagement of the packer with the well bore and the large mass of fluid in the hydrostatic head that restricts resonance in the smaller mass of the tool. It is also inherent with this packer as it is disclosed herein to operate it as a stabilizer, and accordingly the actuated packer centers the bit in the well bore for making straight hole. It is still a further object to separately actuate this basic differential pressure packing tool whereby under balanced drilling conditions beneath the bit can be immediately changed to over balanced conditions. Operation of this basic pressure differential packing tool at the bit can serve as an immediate "first line of defense" against "blow-outs" and "kicks", stopping blow-outs and kicks at their source. The basic packer as it is disclosed herein is set to slide within set casings and the like.

SUMMARY OF THE INVENTION

This invention resides primarily in a packer and drill bit combination and a differential tool used in Big Hole well or shaft drilling by the rotary method wherein circulating fluid is pumped down the drill string to clean the bore bottom during penetration, and to discharge cuttings up the string. The packer seals with the bore hole immediately above the drill bit establishing a drilling zone at the bit-to-bore bottom interface isolated from the well bore annulus above the packer and surrounding the dual drill pipe. The packer functions as a ram that slides down the well bore as hole is made, and it supports the controlled hydrostatic head of fluid in the well bore annulus surrounding the dual drill string while applying a determined weight to the drill bit for efficient penetration. The circulating fluid is confined to the dual drill pipe and isolated from the hydrostatic head of fluid standing in said well bore annulus which supplies a large volume of flushing fluid induced to flow by means of jet pump action that establishes a reduced pressure in the drilling zone at the bit-to-bore bottom interface. The mud pump pressure is employed solely for establishing the differential in pressure while inducing flow of flushing fluid from the well bore annulus.

The circulating fluid or "mud" is circulated by high pressure pumps at the surface, the viscosity and density of which is controlled by specific gravity and by aeration in order to establish a hydrostatic head that balances the hydrostatic bottom hole pressure against the pore pressure of the formation, the average formation pressure gradient factor per foot of depth being about 0.465 p.s.i. Normal drilling operations are conducted at an over balanced condition with the formation pressure gradient in equilibrium or in excess thereof, the hydrostatic head equaling or exceeding the pore pressure; however, over balancing is known to retard the rate of penetration. In order to increase penetration rate under balanced drilling is practiced at the risk of well bore failures; and it is this under balanced condition with which the present invention is particularly concerned, providing differential pressure means by which an under balanced condition prevails only at the bit-to-bore bottom interface, with a normal higher pressure or over balanced condition prevailing in the well bore above the bit and packer. Since pressure changes within the well bore, especially at the bottom of the hole, are quite unpredictable during penetration, the pressure differential tool of the present invention is controllable so than an over balanced condition can be restored immediately and thereby effecting a first line of defense against sudden increases in formation pressures.

The foregoing and various other objects and features of this invention will be apparent and fully understood from the following detailed description of the typical preferred forms and applications thereof, throughout which description reference is made to the accompanying drawings.

PREFERRED EMBODIMENT

Figures 1, 1A:
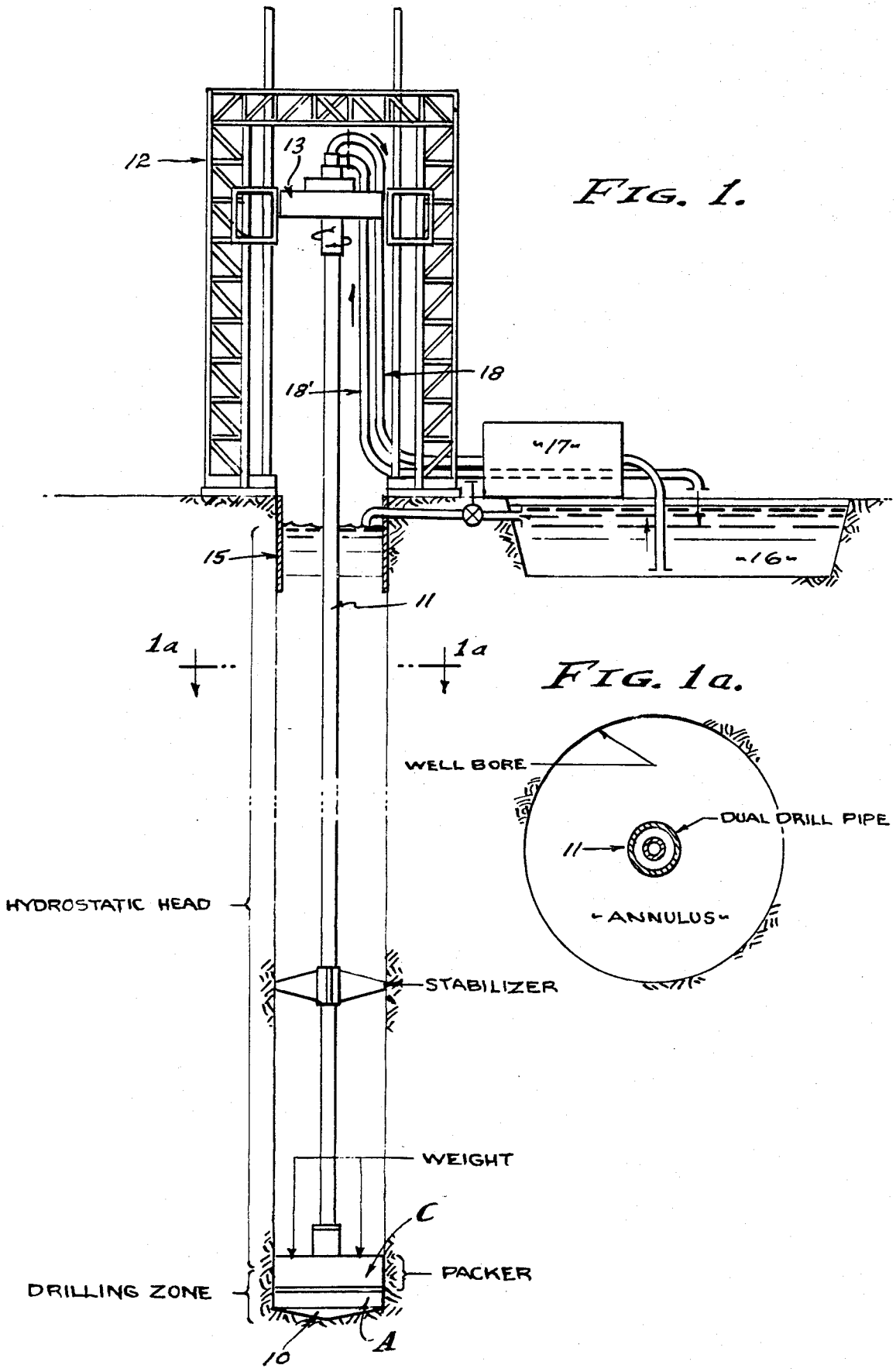
FIG. 1 is a schematic view illustrating the method and apparatus of the present invention.
FIG. 1*a* is an enlarged sectional view taken as indicated by line 1*a*—1*a* on FIG. 1.

Referring now to the drawings, this invention relates to a hydrostatically weighted and pressure differential tool, method and apparatus for Big Hole earth boring. The tool involved is primarily a packer, thrust bearing and bit combination wherein dual drill pipe rotates through the packer during penetration and wherein aerated circulating fluid flushes away the cuttings and preferably including a jet pump controllably operated by the circulating fluid flow to establish reduced pressure below the packer. The pressure differential features of this tool can be incorporated in the stem of the large diameter drill bit, or in a sub, or in a drill collar coupled thereto, all as circumstances require. Generally, this hydrostatically weighted pressure differential tool, method and apparatus for Big Hole well or shaft drilling involves the controlled reduction of fluid pressure in the drilling zone. The pressure differential is substantial and is made significantly possible by a slideable pack-off of the bit body immediately above the bit-to-bore bottom interface, and by providing pump means with suction from said drilling zone and with discharge through the dual drill pipe. It is significant herein that said pack-off provides a barrier or partition so that the hydrostatic head of fluid in the well bore annulus surrounding the dual drill pipe is isolated from the said drilling zone. In the preferred form, the circulating fluid from the mud pumps is used exclusively to operate the jet pump that also induces a large volume flow of flushing fluid from the hydrostatic head of fluid in the well bore annulus surrounding the dual drill pipe. A feature is that the pack-off packer is slideable in the well bore as penetration progresses with pressure differential control by means of fluid pressure applied by surface mud pumps. In accordance with this invention, the pump means is a jet pump that lifts a greater volume of fluid than that required for its operation, the mud pump pressure being controllably applied to reduce the drilling zone pressure as circumstances require. Therefore, reduced drilling zone pressures are established so that the formation pore pressure aids in the rate of penetration, while the hydrostatic head is isolated above the packer seal for well bore integrity.

Referring to FIG. 1 of the drawings, the hydrostatically weighted and pressure differential tool will be described as a packer, thrust bearing and drill bit combination operating to penetrate earth formation at a bit-to-bore bottom interface. As shown schematically, essential to the drilling operation is the drill bit 10, a dual drill pipe 11 comprising an inner drill pipe and an outer concentric drill pipe, a derrick 12, and a rotary "Top Head Drive" 13. The weight of the dual drill pipe 11 is insufficient to supply the weight necessary for bit penetration, and the principle weight therefor is applied from the hyrdrostatic head in the well bore annulus surrounding said dual drill pipe. A surface casing or shaft collar 15 is shown with the hole open for the introduction of a fluid suitable to constitute a hydrostatic head for controlled weight applied to the drill bit 10. Circulating fluid from the dual drill pipe is drawn from a reservoir 16 by mud pumps 17 and forced down the dual drill pipe via a rotary hose 18'. The circulating fluid is returned to reservoir 16 via rotary hose 18 and from which it is drawn to replenish the aforesaid hydrostatic head. The pumps 17 deliver the circulating fluid or "mud" to the rotating drill string at controlled volume and pressure, at controlled viscosity and weight, and aerated as required. The dual drill pipe and associated drilling rig equipment and features are utilized according to the state of the art.

Figure 2:
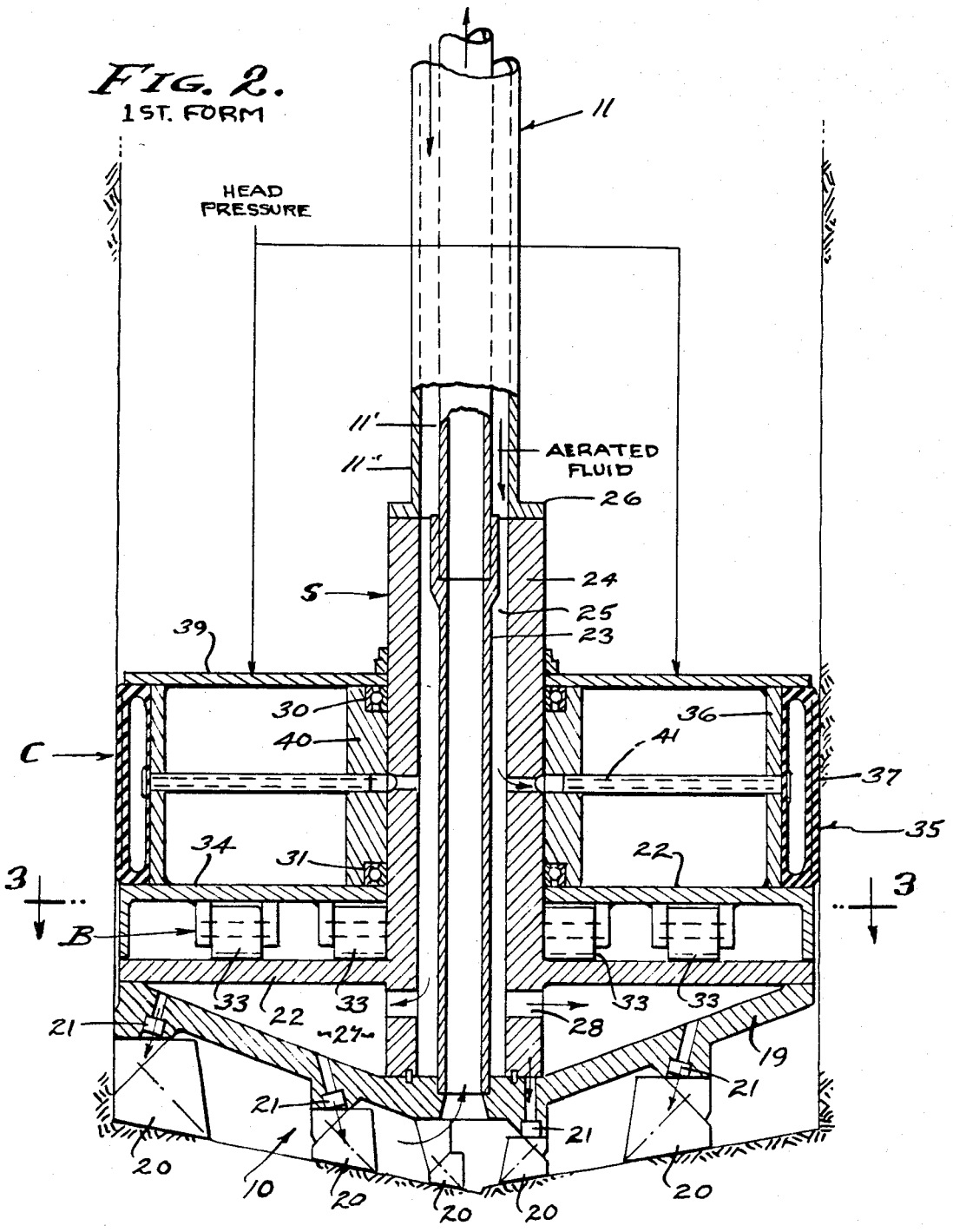
FIG. 2 is a first form and enlarged sectional elevational view of a Packer Weighted And Pressure Differential Tool For Big Hole Drilling as it is operated at the bottom of a dual drill pipe drilling string.
Figure 4:
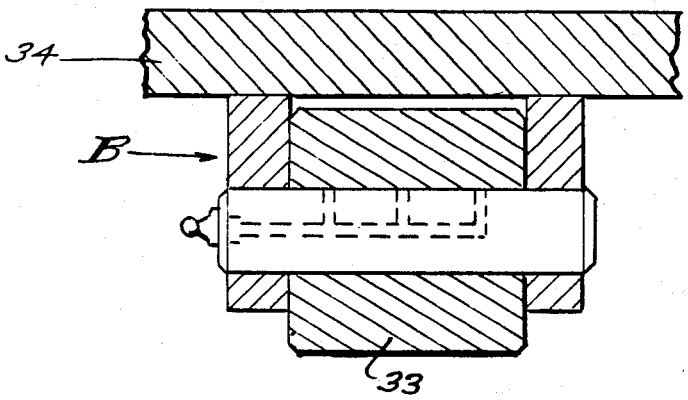
FIG. 4 is an enlarged detailed fragmentary sectional view taken as indicated by line 4—4 on FIG. 3.
Figure 3:
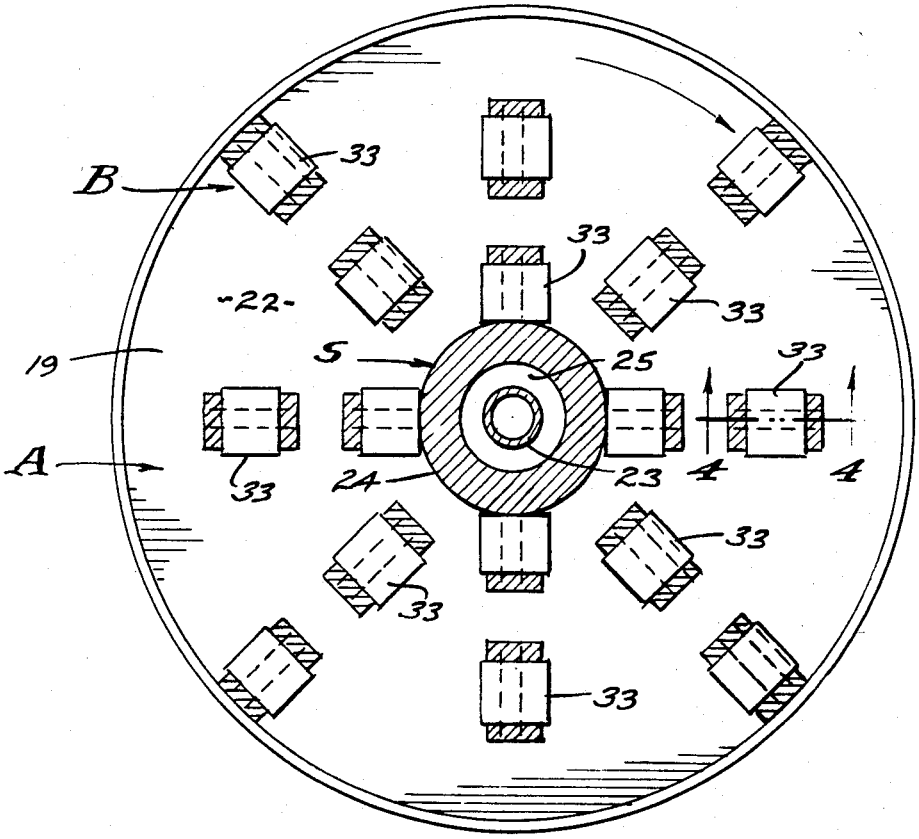
FIG. 3 is a plan sectional view taken as indicated by line 3—3 on FIG. 2.

Referring now to the first and basic embodiment of FIG. 2 of the drawings, this hydrostatically weighted pressure differential tool is an operational unit that includes in combination with the drill bit 10, an expansible packer means sealing with the well bore over the bit, and fluid circulating means. This is a Big Hole rotary drill bit 10 of large diameter (ten to twenty feet) and is characterized by a body A having a cutting face or bottom plate 19 with roller cutters 20 effective coextensively of the bit-to-bore bottom interface and/or bore to be drilled. A plurality of roller cutters 20 are arranged as indicated to track over the entire area of the bore bottom, and each roller cutter is serviced by a bit jet 21 to clean the cuttings therefrom and flush them up the dual drill pipe 11. A packer C is carried over a stem S disposed on the central vertical axis of the tool, the packer being sealed with the stem and forming a partition occluding the well bore and through which the drill bit body A is rotated by the stem S coupled to the dual drill pipe 11. Intermediate the bit body A and packer C there is thrust bearing means B by which the hydrostatic weight of the fluid column above the packer C is applied to the drill bit 10. This first embodiment will be described as a pressure set packer tool operated with aerated circulating fluid and employing a hydrostatic head of fluid supported by the packer and in the well bore annulus surrounding the dual drill pipe.

The bit body A is a rigid structure in the form of a turn table 22 that rotates with the stem S concentric with a central axis extending vertically therethrough. The turn table 22 is horizontal and presents a flat face that faces upwardly to receive the thrust of bearing means B, and the stem S is comprised of dual tubes arranged concentrically as continuations of the dual drill pipe 11. As shown, there is an inner body tube 23 coupled to and continuing from the inner drill pipe 11', and there is an outer body tube 24 coupled to and continuing from the outer drill pipe 11''. The fluid circulating means is embodied in the body tubes 23 and 24 rigid with the turn table 22, one of which conducts circulating fluid under pressure from the mud pumps 17, and the other being open to the drilling zone below the bit 10 and in open communication with the bit-to-bore bottom interface. In the embodiment shown, the annulus 25 between the inner and outer drill pipes conducts the pressurized downward flow of circulating fluid, while the inner drill pipe conducts the upward discharge of flushing fluid. The outer drill pipe is the drive pipe coupled by a flange 26 to the outer body tube 24, the inner drill pipe being coupled by a pin and box joint to the inner body tube 23. The downward flow of circulating fluid is conducted to the bit jets 21 by means of manifolding in the body A and preferably by means of a chamber 27 therein open from the annulus between the body tubes via ports 28. Accordingly, aerated fluid under pressure expands as it is discharged from the bit jets 21 and flushes cuttings upwardly through the inner body tube 23.

During the drilling operation, the packer C is essentially non-rotating and is slideable down the well bore when hole is made, with the stem S rotating in seals therethrough to turn the drill bit 10. Accordingly, the stem S is journaled in the packer by spaced anti-friction radial thrust bearings 30 and 31 that slide on the stem so as to permit the packer C to float axially on the stem while riding upon the axial thrust bearing means B. A feature of this invention is the capture and support of the hydrostatic head of fluid in the well bore annulus by the packer C, and the application of this fluid pressure head as weight to the rotating drill bit 10. Accordingly, the bearing means B is an axial thrust means that transfers the packer load to the turn table 22, shown throughout the drawings herein as a plurality of support rollers 33 spaced circumferentially about the stem S in a multiplicity of circular tracks, so that the hydrostatic load is distributed equally throughout the turn table area. As shown, the bottom member of the packer C is a flat horizontal plate 34 complementary to and coextensively overlying the turn table 22, the support rollers 33 being of uniform diameter rolling freely between the plate 34 and the turn table 22.

The packer C floats axially on the stem S, a limited distance, supported by the axial thrust support rollers 33, and it is either weight set as are other embodiments herein disclosed or pressure set as shown in FIG. 2. The packer C is a partition member that occludes the well bore when set to peripherally engage said bore, and it includes therefore an expansible boot 35 molded or otherwise formed and/or installed over a rim 36 disposed concentric with the stem S and within the well bore. The boot 35 is in the form of a tire having a tread 37 of right cylinder configuration with siping slits (not shown) in its outer surface for conformity to the well bore and to seal therewith. The boot 35 is made of any tough synthetic such as Neoprene rubber, or polyurethane, or ultra high density polyethelene, or the like, and it is a yieldable member, for example of said rubber like materials having a suitable shore hardness and formed to close proximity to the gage of the well bore to be sealed thereby. In practice, the normal unactuated outside diameter of the packer C boot 35 is just under gage with respect to the well bore so as to freely move therein when unset.

The packer C can vary in construction and is comprised essentially of a top and a bottom member. As shown, there is an imperforate top plate 39 spaced axially from the bottom support plate 34 by a sleeve 40 surrounding the stem S and by the rim 36 that carries the packer boot 35. The sleeve 40 is journaled upon the radial thrust bearings 30 and 31 and is rigid with the top and bottom plate members 34 and 39 and rim 36. The packer C as a complete unit is characterized by its right cylinder with the stem S rotatable therethrough and with an expansible periphery in the form of an elastomer boot that seals with the well bore while sliding therealong when hole is made.

In the first form of this invention now under consideration, the expansible boot 35 is inflatable by means of circulating fluid pressure to engage and seal with the well bore and thereby isolate the drilling zone from the fluid filled well bore annulus above the packer C and surrounding the dual drill pipe 11. Accordingly, a hydrostatic head of fluid is established to apply downward axial force through thrust bearing means B and upon the drill bit roller cutters 20. Inflation of the boot 35 is by means of a port 41 opening from the annulus between body tubes 23 and 24 and into the tubular boot cross section backed by the rim 36. In practice, the tread 37 is reinforced by means of one or more circumferential bands so as to have coextensive conformity to the cylindrical well bore. Consequently, when circulating fluid pressure is established by the fluid circulating means against the restrictive orifices of the bit jets 21, the packer C is set to seal with the well bore and is slideable thereagainst to move downwardly with the drill bit 10. Simultaneously the expansion of aerated circulating fluid as it is discharged from the bit jets flushes cuttings up the dual drill pipe 11 and while reducing the pressure significantly in the drilling zone isolated from the hydrostatic head in the annulus above the packer C.

Referring now to the second embodiment of FIG. 5 of the drawings, the hydrostatic head of fluid under pressure supported by the packer C is advantageously supplied as flushing fluid for the removal of cuttings and is induced to flow by fluid circulating means in the form of a jet pump means J that simultaneously reduces pressure in the drilling zone at the bit-to-bore bottom interface below the bit 10. Accordingly, the chamber 27 of the bit body A is in open communication from the well bore annulus above the packer C and surrounding the dual drill pipe 11 via by-pass passages 42 extending longitudinally through the peripheral wall of the stem S. The chamber 27 supplies the hydrostatic head of fluid to the plurality of restrictive bit jets 21, as shown, so that they discharge said fluid into the isolated drilling zone at reduced pressure.

The second embodiment tool now under consideration is a pressure set tool having a centered jet pump means J for optimizing the differential pressures between the hydrostatic head above packer C and the drilling zone at the bit-to-bore bottom interface. A feature of this invention is the isolation of the circulating fluid confined to the dual drill pipe and jet pump means J. In other words, these distinct fluid pressures are isolated, except as modified by drawing flushing fluid from the well annulus which is induced to flow at an increased rate by the jet pump means J. As shown, the bottom plate 19 of the bit body A has a center section 43 that closes off the dual drill pipe continuations of the body tubes 23 and 24 of the stem S, and carries the jet pump intake plenum as will be described, said plenum being open into the drilling zone for the upward induction of cuttings and said flushing fluid supplied in large quantity by the aforesaid hydrostatic head in the well bore annulus.

In accordance with this invention, the jet pump means J is provided to create a differential in pressure below and above the packer C, for inducing the flow of flushing fluid while reducing pressure in the drilling zone below the packer, and all of which is conducive to differential pressure drilling. That is, the pressure in the drilling zone will be lower than the prevailing hydrostatic head of pressure above the packer C. Accordingly, the jet pump means J is incorporated in the stem S to withdraw circulating fluid from and to reduce the pressure in the drilling zone, discharging up the dual drill pipe 11. The function of the jet pump means J is forcible and for its operation relies upon the ejection of circulating fluid through a venturi restriction drawing fluid through the intake plenum open from the drilling zone.

The jet pump means J incorporates the concentric body tube configuration of the stem S that rotates the drill bit 10, and an ejector D of ring configuration replaceably set therein. Characteristically, the interior configuration of jet pump means J is that of an upwardly faced venturi having a lowermost plenum 45, a restricted throat 46, and an uppermost diffuser 47, all of which are concentric with the body tube 23. The plenum 45 opens unrestrictedly from an inlet 48 and is convergent to the restricted throat 46, and the diffuser 47 opens unrestrictedly into the full interior diameter of the inner body tube 23 for unrestricted upward discharge. A feature is that drill bit 10 is a center suction bit with the inlet 48 opening from the drilling zone and into the jet pump plenum 45. In practice, the inlet 48 is by means of a bore that opens through the center of bottom 19 and in open communication with the drilling zone surrounding the plurality of roller cutters 20.

In accordance with this invention, the ejector D is provided to eject flushing fluid from the plenum 45 and the diffuser 47 by projecting high velocity fluid through the restricted throat 46 and thereby creating a substantial and significant differential pressure between the drilling zone and the return passage through the body tube 23 and concentric drill pipe 11'. In carrying out this form of the invention, the circulating fluid under pump pressure is isolated for use through the ejector D and is supplied thereto by the annulus continuing through the stem S from the dual drill pipe 11. Accordingly, orifices 49 of the ejector D are selected to cooperate with the selected flow rate and pressure of the circulating fluid. As shown, the ejector orifices 49 are incorporated in a selectively replaceable ring 50 captured by the connection between stem S and the bit body A, said orifices being disposed so as to project and entrain high pressure circulating fluid through the plenum 45 and into the throat 46 at high velocity for an effective jet pump action followed by discharge through the diffuser 47 and concentric body tube 23 and the drill pipe 11'. Consequently, circulating fluid discharged by the bit jets 21 is at a reduced pressure within the drilling zone, while the higher pressure hydrostatic head in the well bore annulus remains isolated and supported upon the packer C, and with the circulating fluid isolated in the dual drill pipe 11. As shown, there is a circumferential series of upwardly and inwardly disposed ejector orifices 49 formed in the replaceable ring 50 of the ejector D, said orifices directing fluid under pressure from the stem S annulus via a by-pass manifold 51 supplying said orifices.

Figure 5:
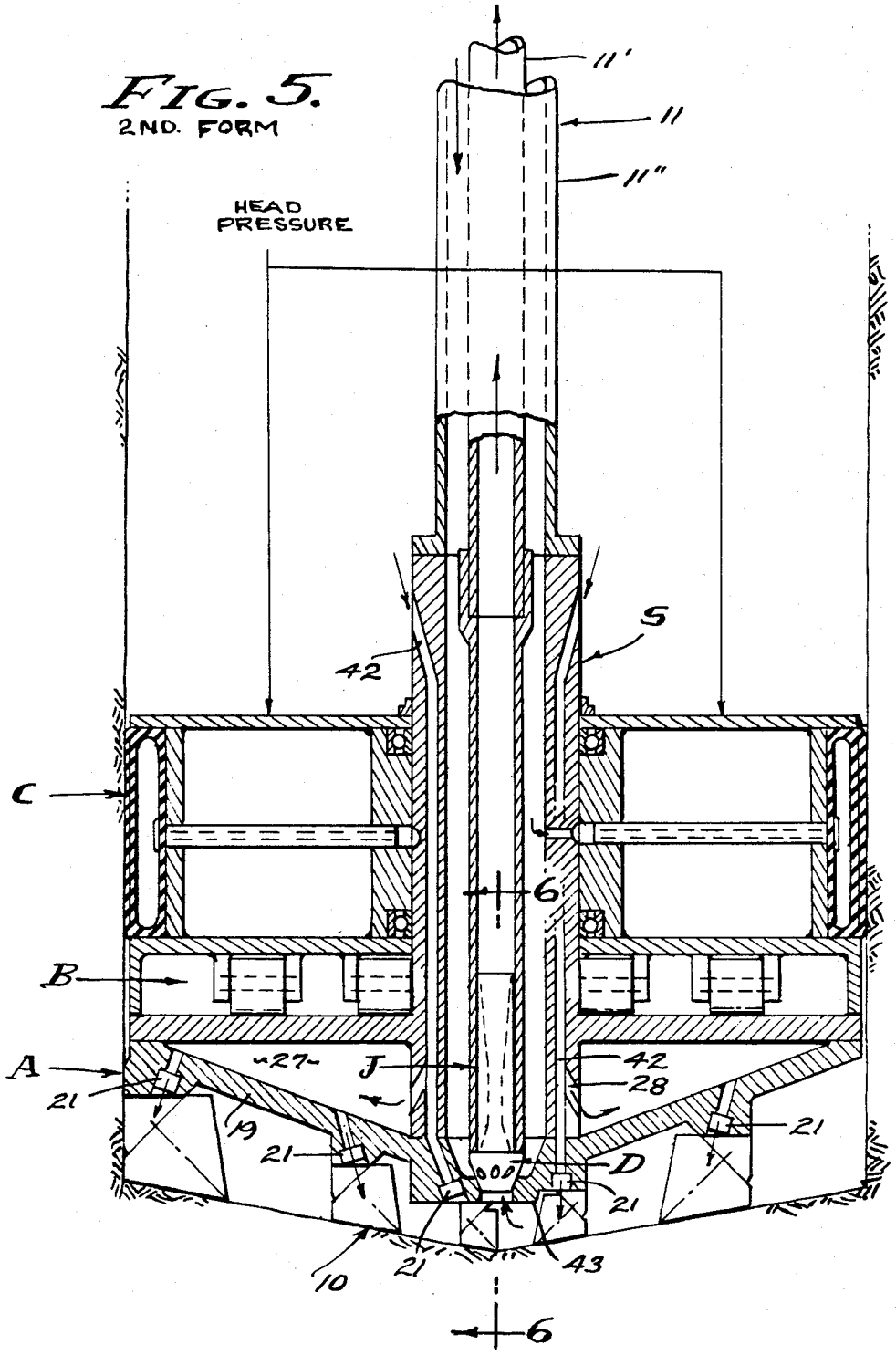
FIG. 5 is a second form and enlarged sectional elevational view of a Pressure Set Center Jet Pump Tool For Big Hole Drilling as it is operated at the bottom of a dual drill pipe drilling string.
Figure 6:
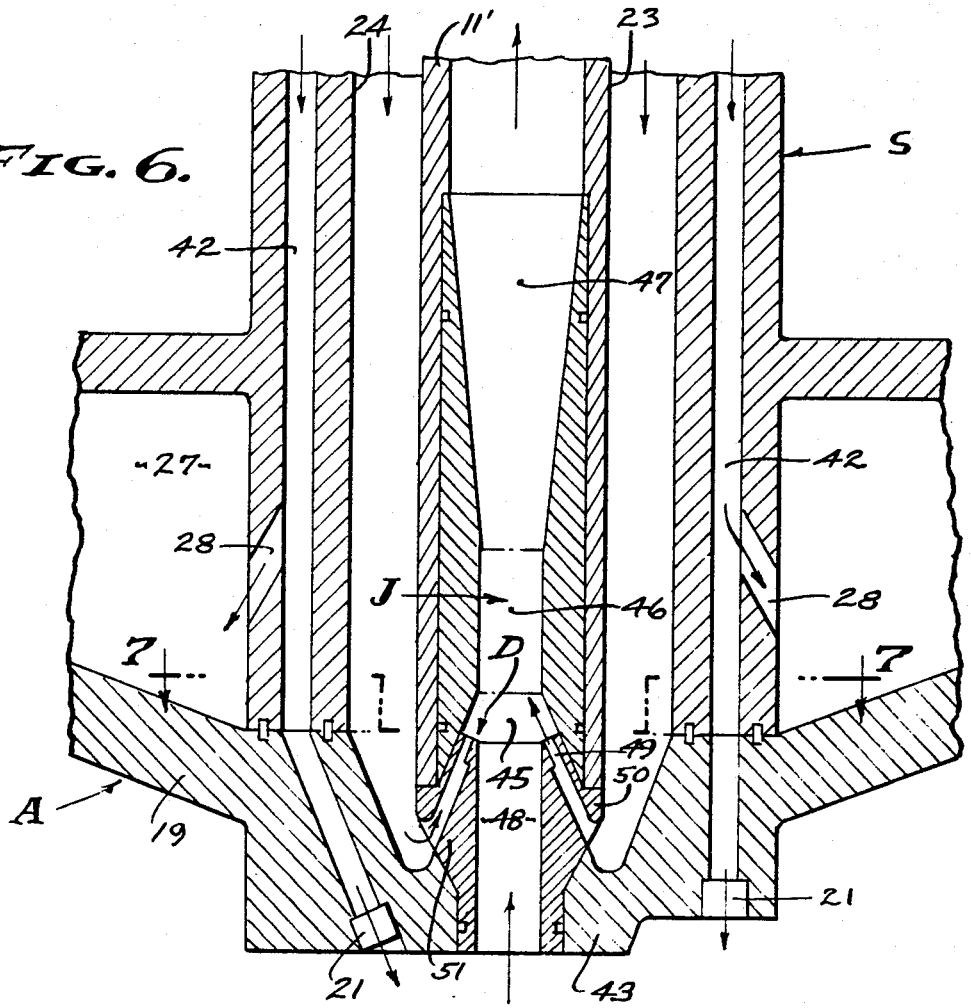
FIG. 6 is an enlarged detailed fragmentary sectional view of the Center Jet Pump as taken by line 6—6 on FIG. 5.
Figure 7:
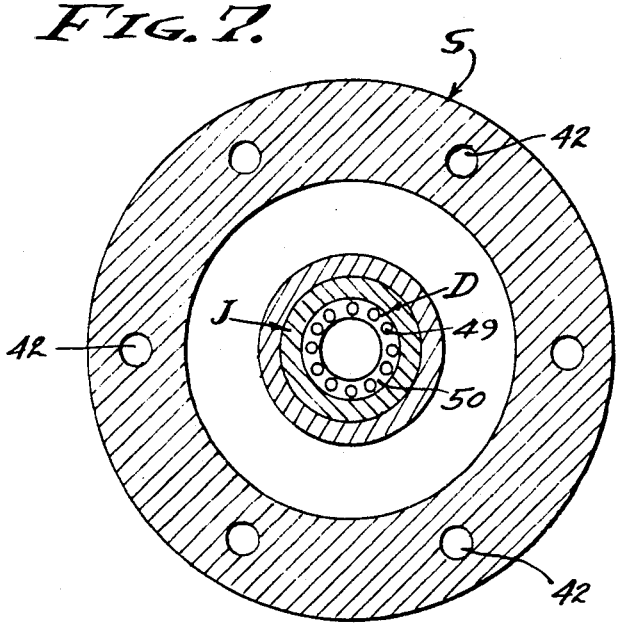
FIG. 7 is a plan sectional view taken as indicated by line 7—7 on FIG. 6.
Figure 8:
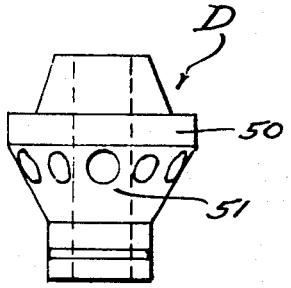
FIG. 8 is a detailed elevation of the replaceable ejector ring removed from the tool.
Figure 9:
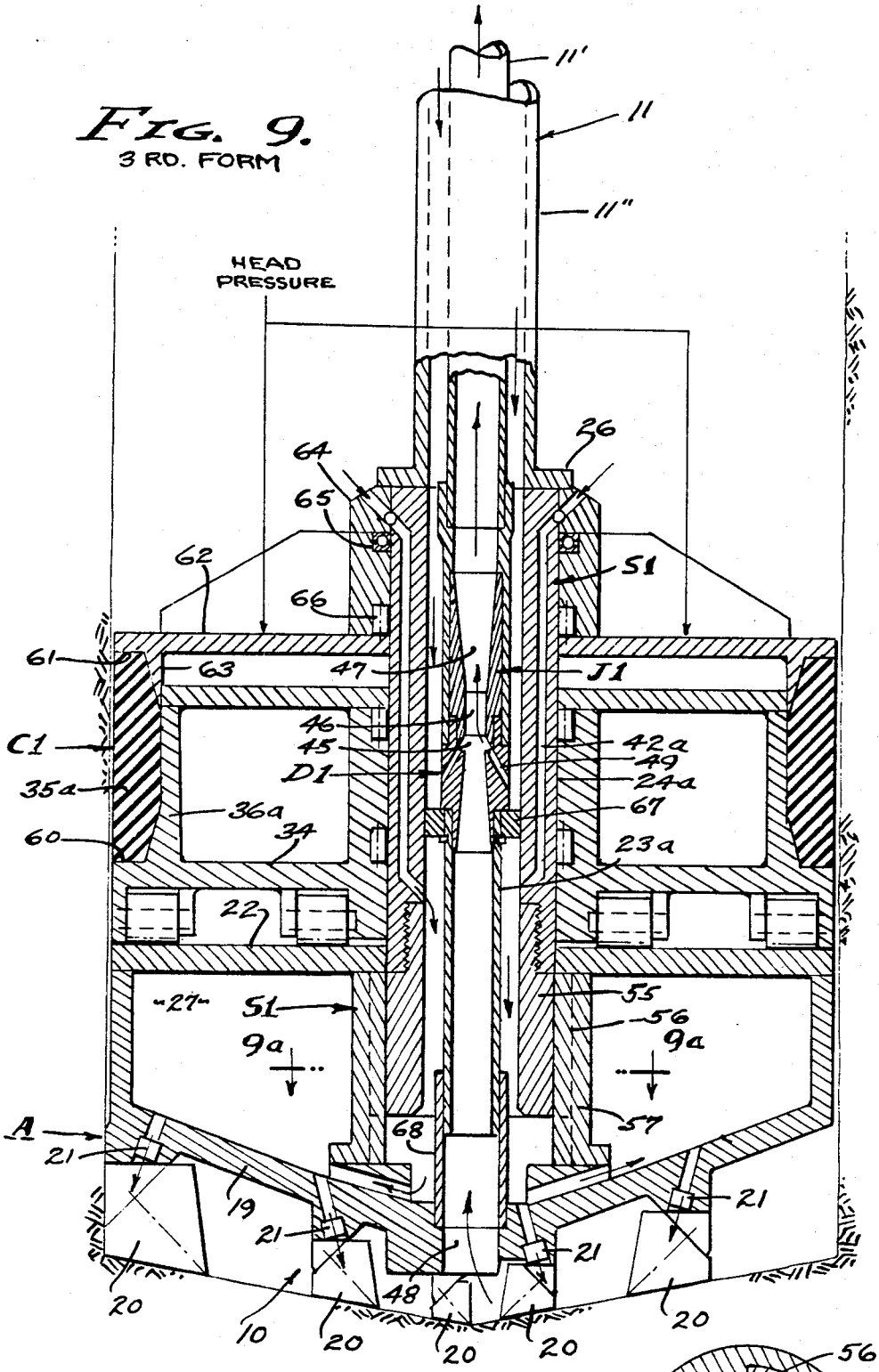
FIG. 9 is a third form and enlarged sectional elevational view of a Weight Set Jet Pump Tool For Big Hole Drilling as it is operated at the bottom of a dual drill pipe drilling string.
Figure 9A:
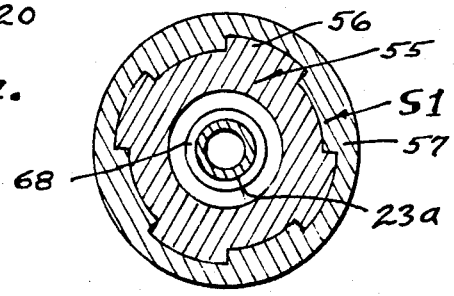
FIG. 9*a* is a detailed sectional view taken as indicated by line 9*a*—9*a* on FIG. 9.

Referring now to the third embodiment of FIG. 9 of the drawings, this hydrostatically weighted pressure differential tool differs from the second embodiment of FIG. 5 by being weight set rather than pressure set. That is, the packer C1 is expanded through the applied weight of the drilling string, requiring a slip joint in the structure of stem S1 and relocation of the jet pump means J1 as it is cooperatively associated with the body tubes 23*a* and 24*a* of stem S1; the tool remaining as above described with respect to the second embodiment in all other respects. For example, the dual drill pipe 11 and its relation to the body tubes 23*a* and 24*a* is the same with open communication from the drilling zone through a bore inlet 48, and the bit body A is essentially the same with a bottom 19 carrying the roller cutters 20 and bit jets 21, and characterized by the turn table 22, and with a chamber 27 that supplies the hydrostatic head of fluid to the jets 21.

The third embodiment tool now under consideration has an axially reciprocable stem S1 having a head 55 with splines 56 slideably engaged with a drive barrel 57 extending between and rigid with the bottom 19 and the turn table 22 of the bit body A. The stem S1 is sectional and comprised of the head 55 and the outer body tube 24*a* threadedly coupled by a pin and box joint, the tube 24*a* being the drive member coupled to the outer drive pipe 11". The axial movement of the head 55 is limited by engagement of the splines 56 between the bottom 19 and the turn table 22. The concentric inner body tube 23*a* is free to move with respect to the bottom 19 and is shown to have telescoped engagement with a tubular extension 68 of the bore inlet 48. Accordingly, the dual drill pipe 11 and splined stem S1 are moveable with respect to the bit body A to engage and lift the same as shown in FIG. 9, and alternately to set down with respect thereto with limited movement stopped by engagement with the bottom 19.

The weight set packer C1 is essentially the same as the packer C first described, except that the expansible elastomer is a solid member subject to axial compression which causes its radial expansion by means of displacement according to known practice in the art. Accordingly, the boot 35*a* is confined to a rim 36*a* between an upwardly faced shoulder 60 and a relatively moveable downwardly faced shoulder 61. The shoulder 60 is in the plane of the support plate 34, while the shoulder 61 is carried by a header 62 depressed by the stem S1 when weight of the drilling string is applied thereto. The header 62 has a skirt 63 telescoped onto the rim 36*a*, the skirt 63 being conically tapered so as to wedge the boot 35*a* radially outward when the header is depressed. Axial downward thrust is applied to the header 62 by a thrust collar 64 underlying the coupling flange 26, applied through antifriction thrust bearing 65. In practice, there are upper and lower bearings 65 and 66 that stabilize the header 62 free to revolve on the stem S1, the packer C1 being substantially non-rotating and slideably sealed with the well bore.

The jet pump means J1 is essentially the same as the second embodiment jet pump means J, and differs only by its insertion in the concentric body tube 23*a*, and by its location above a blind 67 occluding the annulus between tubes 23*a* and 24*a*. As shown, the by-pass passage 42*a* in this embodiment opens into the concentric tube annulus of the stem S1 below the blind 67, and hydrostatic fluid communication into the chamber 27 is via ports 68 from said tube annulus below the splines 56. The jet pump means J1 involves a lowermost plenum 45, a restricted throat 46, and an uppermost diffuser 47, all as hereinabove described. However, the ejector D1 is in the nature of a pin and box coupling threadedly joining upper and lower sections of the inner body tube 23*a*, and with the orifices 49 open from the annulus between tubes 23*a* and 24*a* above the blind 67. The orifices 49 are disposed so as to project and entrain high pressure circulating fluid through the plenum 45 and into the throat 46 at high velocity for an effective jet pump action followed by discharge through the diffuser 47 and concentric body tube 23*a* and drill pipe 11'. The ejector D1 incorporated in the coupling is replaceable as circumstances require.

Figure 10:
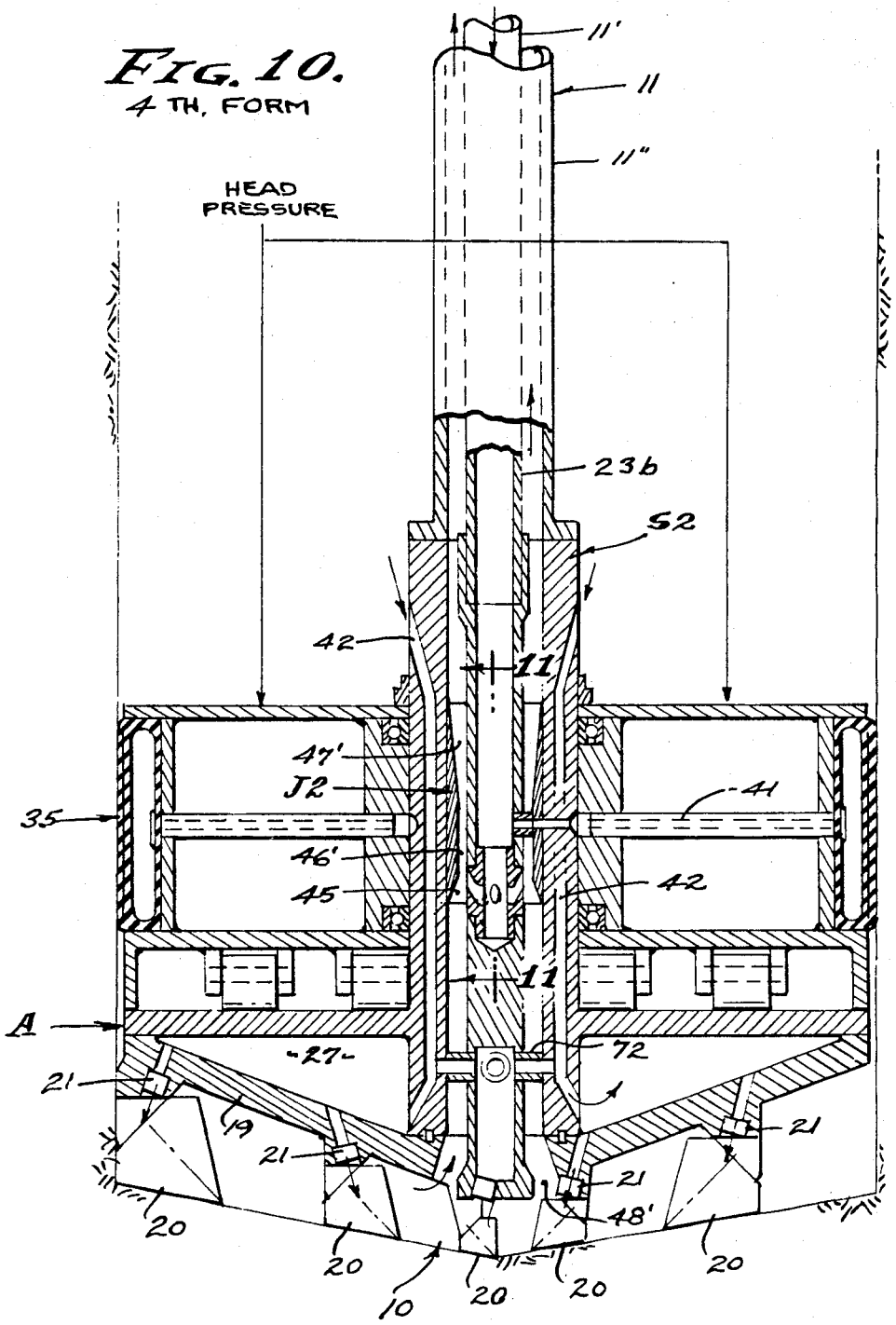
FIG. 10 is a fourth form and enlarged sectional elevational view of a Pressure Set Annulus Jet Pump Tool For Big Hole Drilling as it is operated at the bottom of a dual drill pipe drilling string.
Figure 11:
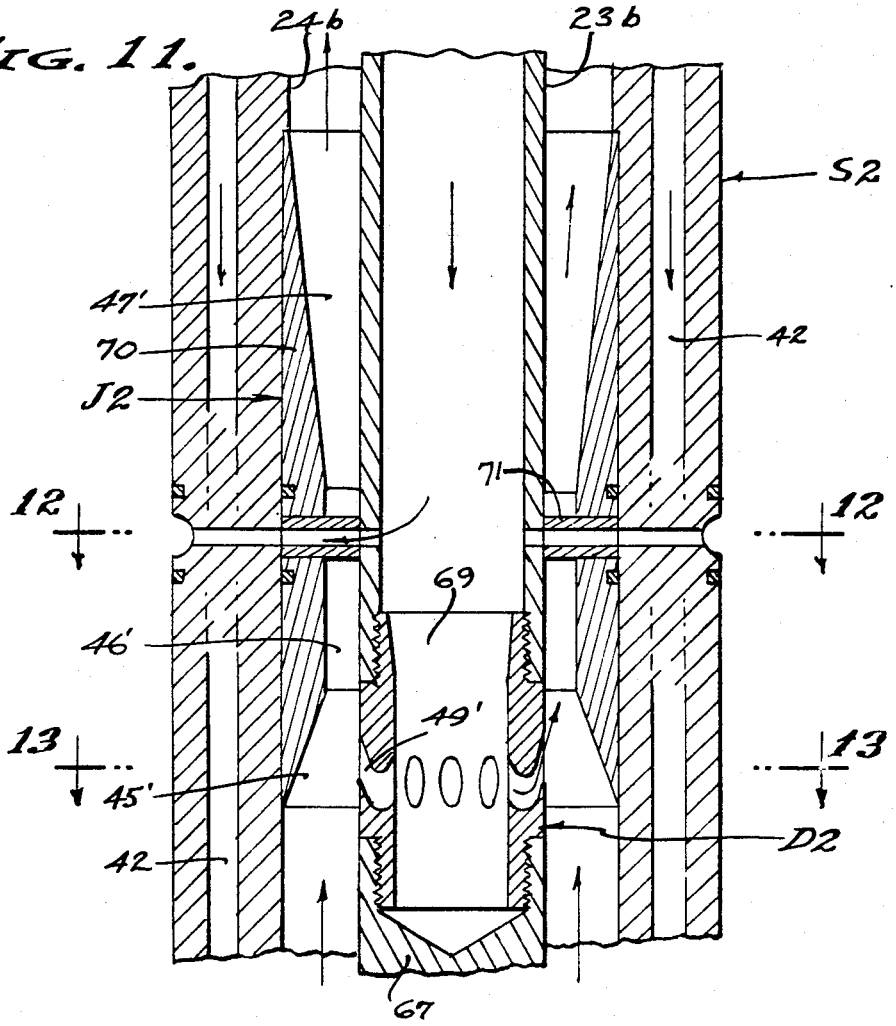
FIG. 11 is an enlarged detailed fragmentary sectional view of the jet pump of annulus from and taken as indicated by line 11—11 on FIG. 10.
Figure 12:
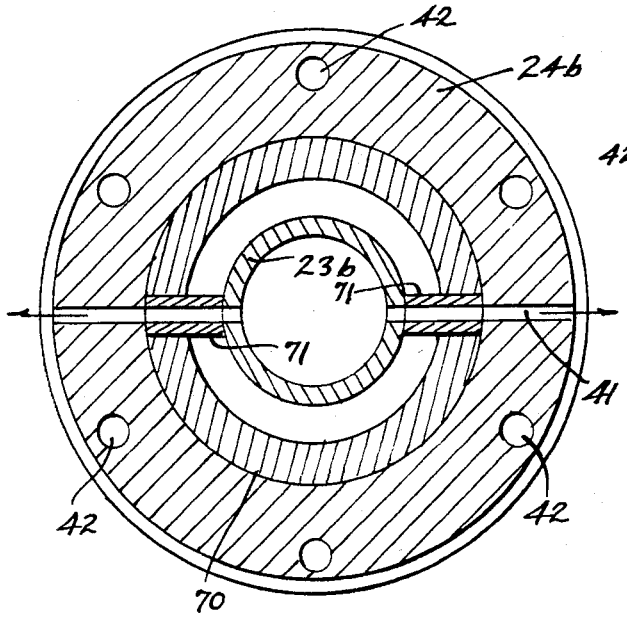
FIGS. 12 and 13 are sectional views taken as indicated by lines 12—12 and 13—13 on FIG. 11.
Figure 13:
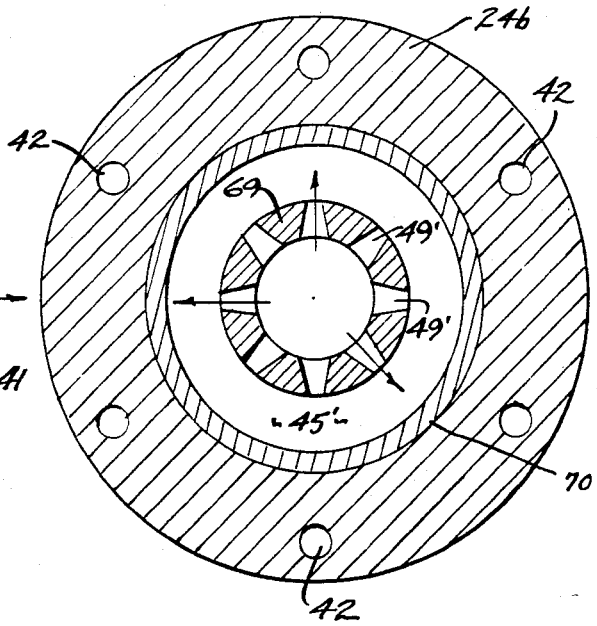

Referring now to the fourth embodiment of FIG. 10 of the drawings, this hydrostatically weighted pressure differential tool differs from the second embodiment of FIG. 5 by its annular configuration with respect to the jet pump means J2 incorporated in the stem S. A feature of this fourth embodiment is that the circulating fluid is pumped downwardly through the concentric inner drill pipe 11' and through the body tube 23*b* of stem S2, while discharge of flushing fluid is upward through the annulus between tubes 23*b* and 24*b*. For example, passages 42 and ports 41 are employed as shown, and the dual drill pipe 11 and its relation to the body tubes 23*b* and 24*b* is the same, and the bit body A is essentially the same with a bottom 19 carrying the roller cutters 20 and bit jets 21, and characterized by the turn table 22 and with a chamber 27 that supplies the hydrostatic head of flushing fluid to the jets. However, the reversal of flow in the dual drill pipe 11 and stem tubes 23*b* and 24*b* requires that the ports 41 be extended from the interior of tube 23*b*, and requiring inlet 48 to be an annular opening complementary to the annulus between tubes 23*b* and 24*b*.

The fourth embodiment now under consideration is pressure set via the ports 41 extending through a tubular spider or bridge 71 extending radially between the body tubes 23*b* and 24*b* and to the packer boot 35. The flushing fluid inlet 48' annulus is formed by a depending extension of the inner tube 23*b* that carries one or more centrally located roller cutters 20 and bit jets 21 in fluid communication with passages 42 through a tubular spider or bridge 72 as shown extending between body tube 23*b* and 24*b*. Like the third embodiment, the inner body tube 23*b* of the stem S2 is sectional and jet pump means J2 is inserted therein and in the annulus between the body tube 23*b* and 24*b*. As shown, the jet pump means J2 involves a sleeve 70 inserted into the outer body tube 24*b*, and which establishes a lowermost plenum 45', a restricted throat 46' and an uppermost diffuser 47', in this case of annular configuration. The sectional inner body tube 23*b* is occluded by a blind 67 above which an ejector D2 is inserted in the nature of a coupling 69 threadedly joining the upper and lower sections of the body tube 23*b*, and with orifices 49' open from the inner body tube 23*b* and into the plenum 45' annulus formed by the sleeve 70 between said body tubes. The orifices 49' are disposed so as to project and entrain high pressure circulating fluid through the plenum 45' and into the throat 46' at high velocity for an effective jet pump action followed by discharge through the diffuser 47' and concentric body tube 23*b* and upwardly through drill pipe 11'. The ejector D2 incorporated in the coupling 69 is replaceable as circumstances require.

Figure 14:
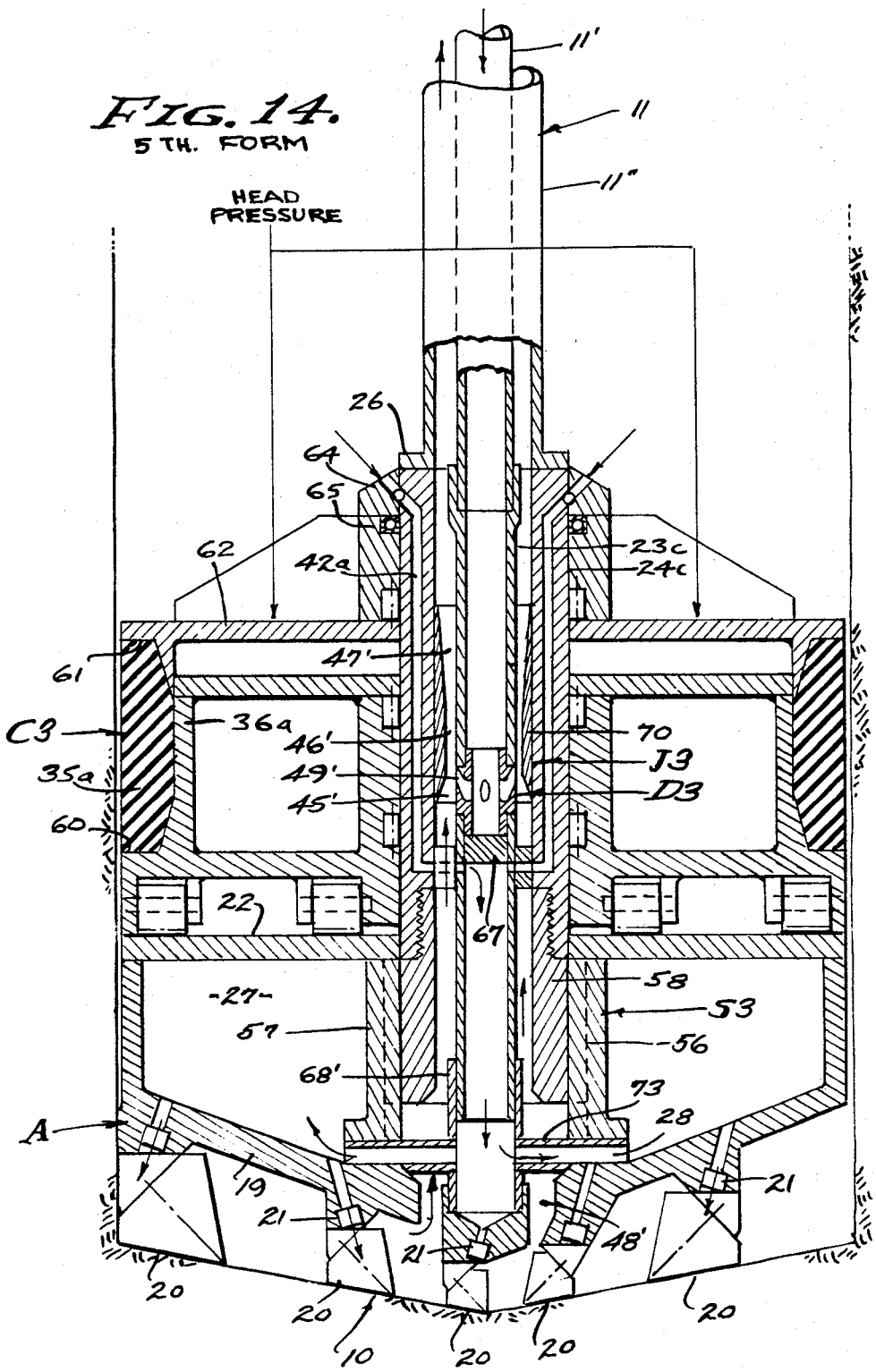
FIG. 14 is a fifth form and enlarged sectional elevational view of a Weight Set Annulus Jet Pump Tool For Big Hole Drilling as it is operated at the bottom of a dual drill pipe drilling string.

Referring now to the fifth embodiment of FIG. 14 of the drawings, this hydrostatically weighted pressure differential tool differs from the fourth embodiment of FIG. 10 by being weight set rather than pressure set. That is, the packer C3 is expanded through the applied weight of the drilling string, requiring a slip joint in the structure of stem S3, the same as hereinabove described with respect to the third embodiment. For example, the dual drill pipe 11 and its relation to the body tubes 23*c* and 24*c* is the same with open communication from the drilling zone through an annulus inlet 48', and the bit body A is essentially the same with a bottom 19 carrying the roller cutters 20 and bit jets 21; and characterized by the turn table 22, and with a chamber 27 that supplies the hydrostatic head of fluid to the jets.

The fifth embodiment now under consideration is weight set having an axially reciprocable stem S3 having a head 55 with splines 56 slideably engaged with a drive barrel 57 extending between and rigid with the bottom 19 and turn table 22 of the bit body A. The stem S3 is sectional and comprised of the head 55 and the outer body tube 24*c* threadedly coupled by a pin and box joint, the tube 24*c* being the drive member coupled to the outer drive pipe 11''. The axial movement of the head 55 is limited by engagement of the splines 56 between the bottom 19 and the turn table 22. The concentric inner body tube 23*c* is free to move with respect to the bottom 19 and is shown to have telescoped engagement with a tubular extension 68' of the bore inlet 48'. Accordingly, the dual drill pipe 11 and splined stem S3 are moveable with respect to the bit body A to engage and lift the same as shown in FIG. 14 and alternately to set down with respect thereto with limited movement stopped by engagement with bottom 19.

The weight set packer C3 is the same as the packer C1 above described, wherein the expansible elastomer is a solid member subject to axial compression which causes its radial expansion by means of displacement according to known practice in the art. Accordingly, there is a boot 35*a* confined to a rim 36*a* between an upwardly faced shoulder 60 and a relatively moveable downwardly faced shoulder 61, all of which is arranged so as to expand the boot 35*a* radially outward when the header 62 is depressed. Axial downward thrust is applied to the header 62 by a thrust collar 64 underlying the coupling flange 26, applied through anti-friction thrust bearing 65. Like the third embodiment, the inner body tube 23*c* of stem S3 is sectional and jet pump means J3 is inserted therein and in the annulus between the body tubes 23*c* and 24*c*. As shown, the jet pump means J3 involves a sleeve 70 inserted into the outer body tube 24*c* and which establishes a lowermost plenum 45', a restricted throat 46', and an uppermost diffuser 47' in this case of annular configuration. The sectional inner body tube 23*c* is occluded by a blind 67 above which an ejector D3 is inserted in the nature of a coupling threadedly joining the upper and lower section of the body tube 23*c*, and with orifices 49' open from the inner body tube 23*c* and into the plenum 45' annulus formed with the sleeve 70 between said body tubes. In this embodiment there is a spider or bridge 73 that occupies the annulus between the body tubes 23*c* and 24*c* for the continuation of by-pass passage 42*c* into the tube 23*c* that supplies the hydrostatic head of fluid under pressure to the chamber 27 via the ports 28'. As shown, there are axial openings 74 around the bridge 73 to pass the flushing fluid and cuttings upwardly to the jet pump means J3. The orifices 49' are disposed so as to project and entrain high pressure circulating fluid through the plenum 45' and into the throat 46' at high velocity for an effective jet pump action followed by discharge through the diffuser 47' and concentric body tube 23*c* and drill pipe 11'. The ejector D3 incorporated in the coupling thereof is replaceable as circumstances require.

From the foregoing it will be seen that various embodiments of this big hole well boring tool are each carried out in the method of the present invention which is characterized by the pressure differential established between the drilling zone and well bore immediate to and above the said drilling zone. A feature of this pressure differential rotary drilling method is the isolation of said drilling zone with packer means slideable in the well bore, whereby significant reduction in pressure can be obtained and so as to establish an unberbalanced condition as compared with the hydrostatic head of pressure in the well bore annulus above said drilling zone. The said isolation is by means of a hydraulic or weight set packer through which the drilling string operates, and preferably within which the drilling string rotates within the well bore. The circulating fluid pressure is released, whereby the bit-to-bore bottom interface is subjected to said underbalanced condition. As shown, a stabilizer is spaced from the lowermost packer, whereby the active drilling portion of the drilling string operates accurately on centers for making straight hole. A significant feature of this invention is the isolation of the circulating fluid through the dual drill pipe used for the reduction of pressure at the bit-to-bore bottom interface, and the isolation of the hydrostatic head of fluid in the well bore annulus surrounding the dual drill pipe and used as a pressure supply of flushing fluid ejected through the bit jets and into the lower pressure drilling zone.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A packer weighted and pressure differential method of big hole well bore drilling through earth formation having a pore pressure opposed by hydrostatic head pressure, and including;

advancing a large diameter drill bit at the lower end of a dual drill pipe of substantially smaller diameter and isolating the flow of circulating fluid therethrough to and from the drill bit, sliding a bore engaging packer down the well bore and rotatably over the dual drill pipe following the drill bit, and thereby separating the well bore into a drilling zone surrounding the drill bit and a hydrostatic head of fluid maintained in the well bore annulus above the packer and surrounding the dual drill pipe, applying the weight of said hydrostatic head to the drill bit through axial thrust bearing means transferring said weight from the sliding packer to and throughout the large diameter drill bit, and significantly reducing the fluid pressure within the said drilling zone responsive to controlled pressure release of the circulating fluid, whereby the large diameter drill bit is weighted to bear against a bit-to-bore bottom interface and the drilling zone subjected to an underbalanced condition as compared to the fluid pressure immediate to and above the sliding packer in the well bore annulus surrounding the dual drill pipe.

2. The packer weighted and pressure differential method of drilling a big hole well bore as set forth in claim 1, wherein reducing of the fluid pressure in the drilling zone is by the expansion of aerated circulating fluid supplied under pressure downwardly through one of the dual drill pipes and released by bit jets and flushing cuttings upwardly through the other one of the dual drill pipes.

3. The packer weighted and pressure differential method of drilling a big hole well bore as set forth in claim 1, wherein the circulating fluid pressure is applied to expand the packer for said sliding bore engaging thereof.

4. The packer weighted and pressure differential method of drilling a big hole well bore as set forth in claim 1, wherein the dual drill pipe weight is applied to expand the packer for said sliding bore engaging thereof.

5. The packer weighted and pressure differential method of drilling a big hole well bore as set forth in claim 1, wherein the isolated flow of circulating fluid is discharged into the drilling zone by bit jets and is directed through jet pump means drawing said fluid from the drilling zone and reducing pressure therein and discharging said fluid as flushing fluid upwardly through the dual drill pipe.

6. The packer weighted and pressure differential method of drilling a big hole well bore as set forth in claim 1, wherein the isolated flow of circulating fluid is aerated fluid discharged into the drilling zone by bit jets and directed through jet pump means drawing said fluid from the drilling zone and reducing pressure therein and discharging and expanding said aerated fluid as flushing fluid upwardly through the dual drill pipe.

7. The packer weighted and pressure differential method of drilling a big hole well bore as set forth in claim 1, wherein reducing of the fluid pressure in the drilling zone is by the expansion of aerated circulating fluid supplied under pressure downwardly through one of the dual drill pipes and released by bit jets into the drilling zone as flusing fluid, and wherein the aerated circulating fluid is directed from said one of the dual drill pipes and through jet pump means drawing said flushing fluid from the drilling zone and reducing pressure therein and discharging said flushing fluid upwardly through the other one of the dual drill pipes.

8. The packer weighted and pressure differential method of drilling a big hole well bore as set forth in claim 1, wherein the hydrostatic head of fluid in the well bore annulus surrounding the dual drill pipe is by-passed into the drilling zone as flushing fluid, and wherein the flow of circulating fluid is directed solely through jet pump means drawing said flushing fluid from the drilling zone and reducing pressure therein and discharging said flushing fluid upwardly through the dual drill pipe.

9. The packer weighted and pressure differential method of drilling a big hole well bore as set forth in claim 1, wherein the hydrostatic head of fluid in the well bore annulus surrounding the dual drill pipe is by-passed to the drilling zone as flushing fluid, and wherein the flow of circulating fluid is aerated fluid directed solely through jet pump means drawing said flushing fluid from the drilling zone and reducing pressure therein and discharging said flushing fluid commingled with expanding aerated fluid upwardly through the dual drill pipe.

10. The packer weighted and pressure differential method of drilling a big hole well bore as set forth in claim 1, wherein the hydrostatic head of fluid in the well bore annulus surrounding the dual drill pipe is by-passed and discharged through bit jets into the drilling zone as flushing fluid, and wherein the flow of circulating fluid is directed solely through jet pump means drawing said flushing fluid from the drilling zone and reducing pressure therein and discharging said flushing fluid upwardly through the dual drill pipe.

11. The packer weighted and pressure differential method of drilling a big hole well bore as set forth in claim 1, wherein the hydrostatic head of fluid in the well bore annulus surrounding the dual drill pipe is by-passed and discharged through bit jets into the drilling zone as flushing fluid, and wherein the flow of circulating fluid is aerated fluid directed solely through jet pump means drawing said flushing fluid from the drilling zone and reducing pressure therein and discharging said flushing fluid commingled with expanding aerated fluid upwardly through the dual drill pipe.

12. A packer weighted and pressure differential tool for big hole well bore drilling through earth formation having a pore pressure opposed by hydrostatic fluid pressure, and including;

a dual tube stem for coupled engagement with a dual drill pipe and operation through a large diameter well bore and with concentric passages isolating the pressured supply and discharge flow of circulating fluid therethrough, there being a well bore annulus surrounding the dual drill pipe, a drill bit carried by the stem for rotation and formation engagement at a bit-to-bore bottom interface, a packer means rotatably carried over the dual tube stem to seal with and slide down the well bore immediate to and above the drill bit and separating said well bore into a drilling zone and a hydrostatic head of fluid supported by the packer means, the drill bit being comprised of a large diameter body carrying cutters having coextensive bore bottom engagement, and means responsive to release of circulating fluid under pressure from one of the dual stem passages and reducing fluid pressure in the drilling zone at the bit-to-bore bottom interface for flushing fluid to remove cuttings from said bore bottom and discharge through the other one of the dual stem passages, and anti-friction axial thrust bearing means operable between the packer means and drill bit body for transferring the weight of the hydrostatic head of fluid supported by the packer means into the drill bit body as said packer means is sliding down the well bore.

13. The packer weighted and pressure differential tool for big hole well bore drilling as set forth in claim 2, wherein the packer means is pressure set into sliding engagement with the well bore by fluid pressure from said one of the dual stem passages and into a radially inflatable boot carried by a rim of the packer means for circumferential engagement with the well bore.

14. The packer weighted and pressure differential tool for big hole well bore drilling as set forth in claim 12, wherein the packer means is weight set into sliding engagement with the well bore by weight of the dual drill pipe moveable axially downward upon a radially expansible elastomer boot carried by a rim of the packer means for radial displacement and circumferential engagement with the well bore.

15. The packer weighted and pressure differential tool for big hole well bore drilling as set forth in claim 12, wherein the anti-friction axial thrust bearing means is comprised of rollers disposed between the packer means and drill bit body to bear upon an upwardly faced table of the drill bit body.

16. The packer weighted and pressure differential tool for big hole well bore drilling as set forth in claim 2, wherein anti-friction axial thrust bearing means is comprised of rollers disposed between the packer means and drill bit body to bear upon an upwardly faced table of the drill bit body, there being a plurality of rollers spaced circumferentially in a multiplicity of concentric .circular tracks to equally distribute the weight of the hydrostatic head of pressure standing in the well bore annulus surrounding the dual drill pipe.

17. The packer weighted and pressure differential tool for big hole well bore drilling as set forth in claim 12, wherein the dual tube stem is comprised of concentrically arranged tubular continuations of the dual drill pipe and carried by and projecting from the drill bit body and rotatable thereon by means of anti-friction radial thrust bearings to rotatably carry the packer means sealed therewith.

18. The packer weighted and pressure differential tool for big hole well bore drilling as set forth in claim 12, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith.

19. The packer weighted and pressure differential tool for big hole well bore drilling as set forth in claim 12, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith, and wherein the anti-friction axial thrust means is comprised of rollers disposed between the packer means and drill bit body to bear upon the upwardly faced table thereof.

20. The packer weighted and pressure differential tool for big hole well bore drilling as set forth in claim 12, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith, and wherein the anti-friction axial thrust bearing means is comprised of rollers disposed between the packer means and drill bit body to bear upon the upwardly faced table of the drill bit body, there being a plurality of rollers spaced circumferentially in a multiplicity of concentric circular tracks to equally distribute the weight of the hydrostatic head of pressure standing in the well bore annulus surrounding the dual drill pipe.

21. The packer weighted and pressure differential tool for big hole well bore drilling as set forth in claim 12, wherein the means responsive to release of circulating fluid for reducing fluid pressure is comprised of bit jets releasing said circulating fluid under pressure as flushing fluid for discharge upwardly through the other one of the dual tube stem passages.

22. The packer weighted and pressure differential tool for big hole well bore drilling as set forth in claim 12, wherein the means responsive to release of circulating fluid for reducing fluid pressure is responsive to the decompression of compressed aerated circulating fluid for reducing fluid pressure and is comprised of bit jets releasing said aerated circulating fluid at reduced pressure as flushing fluid for expansive discharge upwardly through the other one of the dual tube stem passages and continuing dual drill pipe passage.

23. A packer weighted and pressure differential pressure set tool for big hole well bore drilling through earth formation having a pore pressure opposed by hydrostatic fluid pressure, and including;

a dual tube stem for coupled engagement with a dual drill pipe and operation through a large diameter well bore and with concentric passages isolating the pressured supply and discharge flow of circulating fluid therethrough, there being a well bore annulus surrounding the dual drill pipe, and a by-pass passage extending longitudinally through a peripheral wall of the dual tube stem and in open communication with fluid standing in the well bore annulus for downward flow therethrough, a drill bit carried by the stem for rotation and formation engagement at a bit-to-bore bottom interface, and having a chamber in open communication with the by-pass, a packer means rotatably carried over the dual stem to seal with and set by fluid pressure to slide down the well bore immediate to and above the drill bit and separating said well bore into a drilling zone and a hydrostatic head of fluid supported by the packer means, the drill bit being comprised of a large diameter body carrying cutters having coextensive bore bottom engagement, and carrying bit jets exhausting into the drilling zone, and means responsive to release of circulating fluid under pressure from one of the dual stem passages and comprised of a jet pump with an intake plenum open into and reducing fluid pressure in the drilling zone at the bit-to-bore bottom interface for flushing fluid to remove cuttings from said bore bottom and discharge through the other one of the dual stem passages, and anti-friction axial thrust bearing means operable between the packer means and drill bit body for transferring the weight of the hydrostatic head of fluid supported by the packer means into the drill bit body as said packer means is sliding down the well bore.

24. The packer weighted and pressure differential tool for big hole well bore drilling as set forth in claim 23, wherein the packer means is pressure set into sliding engagement with the well bore by fluid pressure from said one of the dual stem passages and into a radially inflatable boot carried by a rim of the packer means for circumferential engagement with the well bore.

25. The packer weighted and pressure differential tool for big hole well bore drilling as set forth in claim 23, wherein the jet pump comprising the means responsive to release of circulating fluid includes an ejector ring receiving downward flow of circulating fluid under pressure from an annulus of the dual tube stem and ejecting into the plenum opening centrally from the drilling zone for pressure reduction through a throat and diffuser in open communication therewith and upward discharge through a center passage of the dual tube stem.

26. The packer weighted and pressure differential tool for big hole well bore drilling as set forth in claim 25, wherein the anti-friction axial thrust bearing means is comprised of rollers disposed between the packer means and drill bit body to bear upon an upwardly faced table of the drill bit body.

27. The packer weighted and pressure differential tool for big hole well bore drilling as set forth in claim 25, wherein the anti-friction axial thrust bearing means is comprised of rollers disposed between the packer means and drill bit body to bear upon an upwardly faced table of the drill bit body, there being a plurality of rollers spaced circumferentially in a multiplicity of concentric circular tracks to equally distribute the weight of the hydrostatic head of pressure standing in the well bore annulus surrounding the dual drill pipe.

28. The packer weighted and pressure differential tool for big hole well bore drilling as set forth in claim 25, wherein the dual tube stem is comprised of concentrically arranged tubular continuations of the dual drill pipe and carried by and projecting from the drill body and rotatable thereon by means of anti-friction radial thrust bearings to rotatably carry the packer means sealed therewith.

29. The packer weighted and pressure differential tool for big hole well bore drilling as set forth in claim 5, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith.

30. The packer weighted and pressure differential tool for big hole well bore drilling as set forth in claim 25, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith, and wherein the anti-friction axial thrust means is comprised of rollers disposed between the packer means and drill bit body to bear upon the upwardly faced table thereof.

31. The packer weighted and pressure differential tool for big hole well bore drilling as set forth in claim 25, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith, and wherein the anti-friction axial thrust bearing means is comprised of rollers disposed between the packer means and drill bit body to bear upon the upwardly faced table of the drill bit body, there being a plurality of rollers spaced circumferentially in a multiplicity of concentric circular tracks to equally distribute the weight of the hydrostatic head of pressure standing in the well bore annulus surrounding the dual drill pipe.

32. The packer weighted and pressure differential tool for big hole well bore drilling as set forth in claim 25, wherein the means responsive to release of circulating fluid for reducing fluid pressure is responsive to the decompression of compressed aerated circulating fluid through the jet pump for reducing fluid pressure thereof as flushing fluid for expansive discharge upwardly through the other one of the dual tube stem passages and continuing dual drill pipe passage.

33. The packer weighted and pressure differential tool for big hole well bore drilling as set forth in claim 23, wherein the jet pump comprising the means responsive to release of circulating fluid includes an ejector ring receiving downward flow of circulating fluid under pressure from an annulus of the dual tube stem and with a circumferential series of orifices ejecting into the plenum opening centrally from the drilling zone for pressure reduction through a throat and diffuser in open communication therewith and upward discharge through a center passage of the dual tube stem.

34. The packer weighted and pressure differential tool for big hole well bore drilling as set forth in claim 23, wherein the jet pump comprising the means responsive to release of circulating fluid includes a replaceable ejector ring in the form of a coupling in the dual tube stem and receiving downward flow of circulating fluid under pressure from an annulus of the dual tube stem and ejecting into the plenum opening centrally from the drilling zone for pressure reduction through a throat and diffuser in open communication therewith and upward discharge through a center passage of the dual tube stem.

35. The packer weighted and pressure differential tool for big hole well bore drilling as set forth in claim 23, wherein the jet pump comprising the means responsive to release of circulating fluid includes a replaceable ejector ring in the form of a coupling in the dual tube stem and receiving downward flow of circulating fluid under pressure from an annulus of the dual tube stem and with a circumferential series of orifices ejecting into the plenum opening centrally from the drilling zone for pressure reduction through a throat and diffuser in open communication therewith and upward discharge through a center passage of the dual tube stem.

36. The packer weighted and pressure differential tool for big hole well bore drilling as set forth in claim 23, wherein the jet pump comprising the means responsive to release of circulating fluid includes an ejector ring receiving downward flow of circulating fluid under pressure from a center tube of the dual tube stem and ejecting into the plenum opening annulus from the drilling zone for pressure reduction through an annulus throat and an annulus diffuser in open communication therewith and upward discharge through an annulus passage of the dual tube stem.

37. The packer weighted and pressure differential tool for big hole well bore drilling as set forth in claim 36, wherein the anti-friction axial thrust bearing means is comprised of rollers disposed between the packer means and drill bit body to bear upon an upwardly faced table of the drill bit body.

38. The packer weighted and pressure differential tool for big hole well bore drilling as set forth in claim 36, wherein anti-friction axial thrust bearing means is comprised of rollers disposed between the packer means and drill bit body to bear upon an upwardly faced table of the drill bit body, there being a plurality of rollers spaced circumferentially in a multiplicity of concentric circular tracks to equally distribute the weight of the hydrostatic head of pressure standing in the well bore annulus surrounding the dual drill pipe.

39. The packer weighted and pressure differential tool for big hole well bore drilling as set forth in claim 36, wherein the dual tube stem is comprised of concentrically arranged tubular continuations of the dual drill pipe and carried by and projecting from the drill bit body and rotatable thereon by means of anti-friction radical thrust bearings to rotatably carry the packer means sealed therewith.

40. The packer weighted and pressure differential tool for big hole well bore drilling as set forth in claim 36, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith.

41. The packer weighted and pressure differential tool for big hole well bore drilling as set forth in claim 36, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith, and wherein the anti-friction axial thrust means is comprised of rollers disposed between the packer means and drill bit body to bear upon the upwardly faced table thereof.

42. The packer weighted and pressure differential tool for big hole well bore drilling as set forth in claim 36, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith, and wherein the anti-friction axial thrust bearing means is comprised of rollers disposed between the packer means and drill bit body to bear upon the upwardly faced table of the drill bit body, there being a plurality of rollers spaced circumferentially in a multiplicity of concentric circular tracks to equally distribute the weight of the hydrostatic head of pressure standing in the well bore annulus surrounding the dual drill pipe.

43. The packer weighted and pressure differential tool for big hole well bore drilling as set forth in claim 36, wherein the means responsive to release of circulating fluid for reducing fluid pressure is responsive to the decompression of compressed aerated circulating fluid through the jet pump for reducing fluid pressure thereof as flushing fluid for expansive disharge upwardly through the other one of the dual tube stem passages and continuing dual drill pipe passage.

44. The packer weighted and pressure differential tool for big hole well bore drilling as set forth in claim 23, wherein the jet pump comprising the means responsive to release of circulating fluid includes an ejector ring receiving downward flow of circulating fluid under pressure from a center tube of the dual tube stem and with a circumferential series of orifices ejecting into an annulus opening from the drilling zone for pressure reduction through an annulus throat and an annulus diffuser in open communication therewith and upward discharge through an annulus passage of the dual tube stem.

45. The packer weighted and pressure differential tool for big hole well bore drilling as set forth in claim 23, wherein the jet pump comprising the means responsive to release of circulating fluid includes a replaceable ejector ring in the form of a coupling in the dual tube stem and receiving downward flow of circulating fluid under pressure from a center tube of the dual tube stem and ejecting into an anulus plenum opening from the drilling zone for pressure reduction through an annulus throat and an annulus diffuser in open communication therewith and upward discharge through an annulus passage of the dual tube stem.

46. The packer weighted and pressure differential tool for big hole well bore drilling as set forth in claim 23; wherein the jet pump comprising the means responsive to release of circulating fluid includes a replaceable ejector ring in the form of a coupling in the dual tube stem and receiving downward flow of circulating fluid under pressure from a center tube of the dual tube stem and with a circumferential series of orifices ejecting into an annulus plenum opening from the drilling zone for pressure reduction through an annulus throat and an annulus diffuser in open communication therewith and upward discharge through an annulus center passage of the dual tube stem.

47. A packer weighted and pressure differential weight set tool for big hole well bore drilling through earth formation having a pore pressure opposed by hydrostatic fluid pressure, and including;

a dual tube stem for coupled engagement with a dual drill pipe and operation through a large diameter well bore and with concentric passages isolating the pressured supply and discharge flow of circulating fluid therethrough, there being a well bore annulus surrounding the dual drill pipe, and a bypass passage extending longitudinally through a peripheral wall of the dual tube stem and in open communication with fluid standing in the well bore annulus for downward flow therethrough, a drill bit shiftably carried by the stem with a splined coupling to the dual drill pipe for rotation of the bit and its formation engagement at a bit-to-bore bottom interface, and having a chamber in open communication with the by-pass, a packer means rotatably carried over the dual stem and responsive to shifting of the dual drill pipe downwardly thereto to seal with and set by weight of the dual drill pipe to slide down the well bore immediate to and above the drill bit and separating said well bore into a drilling zone and a hydrostatic head of fluid supported by the packer means, the drill bit being comprised of a large diameter body carrying cutters having coextensive bore bottom engagement, and carrying bit jets exhausting into the drilling zone, and means responsive to release of circulating fluid under pressure from one of the dual stem passages and comprised of a jet pump with an intake plenum open into and reducing fluid pressure in the drilling zone at the bit-to-bore bottom interface for flushing fluid to remove cuttings from said bore bottom and discharge through the other one of the dual stem passages, and anti-friction axial thrust bearing means operable between the packer means and drill bit body for transferring the weight of the hydrostatic head of fluid supported by the packer means into the drill bit body as said packer means is sliding down the well bore.

48. The packer weighted and pressure differential tool for big hole well bore drilling as set forth in claim 47, wherein the packer means is weight set into sliding engagement with the well bore by downward weight of a header rotatable over the dual drill pipe and having a shoulder applying axial pressure against a radially expansible elastomeric boot carried by a rim of the packer means for circumferential engagement with the well bore.

49. The packer weighted and pressure differential tool for big hole well bore drilling as set forth in claim 47, wherein the jet pump comprising the means responsive to release of circulating fluid includes an ejector ring receiving downward flow of circulating fluid under pressure from an annulus of the dual tube stem and ejecting into the plenum opening centrally from the drilling zone for pressure reduction through a throat and diffuser in open communication therewith and upward discharge through a center passage of the dual tube stem.

50. The packer weighted and pressure differential tool for big hole well bore drilling as set forth in claim 49, wherein the anti-friction axial thrust bearing means is comprised of rollers disposed between the packer means and drill bit body to bear upon an upwardly faced table of the drill bit body.

51. The packer weighted and pressure differential tool for big hole well bore drilling as set forth in claim 49, wherein anti-friction axial thrust bearing means is comprised of rollers disposed between the packer means and drill bit body to bear upon an upwardly faced table or the drill bit body, there being a plurality of rollers spaced circumferentially in a multiplicity of concentric circular tracks to equally distribute the weight of the hydrostatic head of pressure standing in the well bore annulus surrounding the dual drill pipe.

52. The packer weighted and pressure differential tool for big hole well bore drilling as set forth in claim 49, wherein the dual tube stem is comprised of concentrically arranged tubular continuations of the dual drill pipe and carried by and projecting from the drill body and rotatable thereon by means of anti-friction radial thrust bearings to rotatably carry the packer means sealed therewith.

53. The packer weighted and pressure differential tool for big hole well bore drilling as set forth in claim 49, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith.

54. The packer weighted and pressure differential tool for big hole well bore drilling as set forth in claim 49, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith, and wherein the anti-friction axial thrust means is comprised of rollers disposed between the packer means and drill bit body to bear upon the upwardly faced table thereof.

55. The packer weighted and pressure differential tool for big hole well bore drilling as set forth in claim 49, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith, and wherein the anti-friction axial thrust bearing means is comprised of rollers disposed between the packer means and drill bit body to bear upon the upwardly faced table of the drill bit body, there being a plurality of rollers spaced circumferentially in a multiplicity of concentric circular tracks to equally distribute the weight of the hydrostatic head of pressure standing in the well bore annulus surrounding the dual drill pipe.

56. The packer weighted and pressure differential tool for big hole well bore drilling as set forth in claim 49, wherein the means responsive to release of circulating fluid for reducing fluid pressure is responsive to the decompression of compressed aerated circulating fluid through the jet pump for reducing fluid pressure thereof as flushing fluid for expansive discharge upwaardly through the other one of the dual tube stem passages and continuing dual drill pipe passage.

57. The packer weighted and pressure differential tool for big hole well bore drilling as set forth in claim 47 wherein the jet pump comprising the means responsive to release of circulating fluid includes an ejector ring receiving downward flow of circulating fluid under pressure from an annulus of the dual tube stem and with a circumferential series of orifices ejecting into the plenum opening centrally from the drilling zone for pressure reduction through a throat and diffuser in open communication therewith and upward discharge through a center passage of the dual tube stem.

58. The packer weighted and pressure differential tool for big hole well bore drilling as set forth in claim 47 wherein the jet pump comprising the means responsive to release of circulating fluid includes a replaceable ejector ring in the form of a coupling in the dual tube stem and receiving downward flow of circulating fluid under pressure from an annulus of the dual tube stem and ejecting into the plenum opening centrally from the drilling zone for pressure reduction through a throat and diffuser in open communication therewith and upward discharge through a center passage of the dual tube stem.

59. The packer weighted an pressure differential tool for big hole well bore drilling as set forth in claim 47 wherein the jet pump comprising the means responsive to release of circulating fluid includes a replaceable ejector ring in the form of a coupling in the dual tube stem and receiving downward flow of circulating fluid under pressure from an annulus of the dual tube stem and with a circumferential series of orifices ejecting into the plenum opening centrally from the drilling zone for pressure reduction through a throat and diffuser in open communication therewith and upward discharge through a center passage of the dual tube stem.

60. The packer weighted and pressure differential tool for big hole well bore drilling as set forth in claim 47, wherein the jet pump comprising the means responsive to release of circulating fluid includes an ejector ring receiving downward flow of circulating fluid under pressure from a center tube of the dual tube stem and ejecting into the plenum opening annulus from the drilling zone for pressure reduction through an annulus throat and an annulus diffuser in open communication therewith and upward discharge through an annulus passage of the dual tube stem.

61. The packer weighted and pressure differential tool for big hole well bore drilling as set forth in claim 60, wherein the anti-friction axial thrust bearing means is comprised of rollers disposed between the packer means and drill bit body to bear upon an upwardly faced table of the drill bit body.

62. The packer weighted and pressure differential tool for big hole well bore drilling as set forth in claim 60, wherein anti-friction axial thrust bearing means is comprised of rollers disposed between the packer means and drill bit body to bear upon an upwardly faced table of the drill bit body, there being a plurality of rollers spaced circumferentially in a multiplicity of concentric circular tracks to equally distribute the weight of the hydrostatic head of pressure standing in the well bore annulus surrounding the dual drill pipe.

63. The packer weighted and pressure differential tool for big hole well bore drilling as set forth in claim 60, wherein the dual tube stem is comprised of concentrically arranged tubular continuations of the dual drill pipe and carried by and projecting from the drill bit body and rotatable thereon by means of anti-friction radial thrust bearings to rotatably carry the packer means sealed therewith.

64. The packer weighted and pressure differential tool for big hole well bore drilling as set forth in claim 60, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith.

65. The packer weighted and pressure differential tool for big hole well bore drilling as set forth in claim 60, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith, and wherein the anti-friction axial thrust means is comprised of rollers disposed between the packer means and drill bit body to bear upon the upwardly faced table thereof.

66. The packer weighted and pressure differential tool for big hole well bore drilling as set forth in claim 60, wherein the dual tube stem is comprised of concentrically arranged tubular continuations of the dual drill pipe and carried by and projecting upwardly from a table forming the top of the drill bit body and rotatable thereon by means of anti-friction radial thrust bearings to rotatably carry the packer means sealed therewith, and wherein the anti-friction axial thrust bearing means is comprised of rollers disposed between the packer means and drill bit body to bear upon the upwardly faced table of the drill bit body, there being a plurality of rollers spaced circumferentially in a multiplicity of concentric circular tracks to equally distribute the weight of the hydrostatic head of pressure standing in the well bore annulus surrounding the dual drill pipe.

67. The packer weighted and pressure differential tool for big hole well bore drilling as set forth in claim 60, wherein the means responsive to release of circulating fluid for reducing fluid pressure is responsive to the decompression of compressed aerated circulating fluid through the jet pump for reducing fluid pressure thereof as flushing fluid for expansive discharge upwardly through the other one of the dual tube stem passages and continuing dual drill pipe passage.

68. The packer weighted and pressure differential tool for big hole well bore drilling as set forth in claim 47, wherein the jet pump comprising the means responsive to release of circulating fluid includes an ejector ring receiving downward flow of circulating fluid under pressure from a center tube of the dual tube stem and with a circumferential series of orifices ejecting into an annulus opening from the drilling zone for pressure reduction through an annulus throat and an annulus diffuser in open communication therewith and upward discharge through an annulus passage of the dual tube stem.

69. The packer weighted and pressure differential tool for big hole well bore drilling as set forth in claim 47, wherein the jet pump comprising the means responsive to release of circulating fluid includes a replaceable ejector ring in the form of a coupling in the dual tube stem and receiving downward flow of circulating fluid under pressure from a center tube of the dual tube stem and ejecting into an annulus plenum opening from the drilling zone for pressure reduction through an annulus throat and an annulus diffuser in open communication therewith and upward discharge through an annulus passage of the dual tube stem.

70. The packer weighted and pressure differential tool for big hole well bore drilling as set forth in claim 47, wherein the jet pump comprising the means responsive to release of circulating fluid includes a replaceable ejector ring in the form of a coupling in the dual tube stem and receiving downward flow of circulating fluid under pressure from a center tube of the dual tube stem and with a circumferential series of orifices ejecting into an annulus plenum opening from the drilling zone for pressure reduction through an annulus throat and an annulus diffuser in open communication therewith and upward discharge through an annulus center passage of the dual tube stem.

* * * * *